US008730125B2

(12) United States Patent
De Flaviis et al.

(10) Patent No.: US 8,730,125 B2
(45) Date of Patent: May 20, 2014

(54) LOW-COST HIGH-GAIN PLANAR ANTENNA USING A METALLIC MESH CAP FOR MILLIMETER-WAVE FREQEUNCY THEREOF

(75) Inventors: Franco De Flaviis, Irvine, CA (US); S. Ali Hosseini, Irvine, CA (US); Filippo Capolino, Irvine, CA (US)

(73) Assignee: The Regents of the University of California, Oakland, CA (US)

( * ) Notice: Subject to any disclaimer, the term of this patent is extended or adjusted under 35 U.S.C. 154(b) by 184 days.

(21) Appl. No.: 13/424,332

(22) Filed: Mar. 19, 2012

(65) Prior Publication Data

US 2013/0241785 A1 Sep. 19, 2013

(51) Int. Cl.
*H01Q 15/02* (2006.01)

(52) U.S. Cl.
USPC ..... 343/909; 343/770

(58) Field of Classification Search
USPC ..... 343/909, 770, 700 MS, 846, 848, 767, 343/756
See application file for complete search history.

(56) References Cited

U.S. PATENT DOCUMENTS

| | | | | |
|---|---|---|---|---|
| 5,917,458 | A * | 6/1999 | Ho et al. | 343/909 |
| 7,342,549 | B2 * | 3/2008 | Anderson | 343/770 |
| 8,502,741 | B2 * | 8/2013 | Lin et al. | 343/702 |

FOREIGN PATENT DOCUMENTS

EP 0 642 190 * 3/1995 ..... H01Q 1/32

OTHER PUBLICATIONS

Von Trentini, Giswalt (1956). "Partially reflecting sheet arrays". *Ire Transactions on Antennas and Propagation*, pp. 666-671.
Jackson, David R. and Alexopoulos, Nicolaos G. (1985). "Gain enhancement methods for printed circuit antennas". *IEEE Transactions on Antennas and Propagation*, AP-33(9), pp. 976-987.
Yang, H.Y., Alexopoulos, Nicolaos G. (1987). "Gain enhancement methods for printed circuit antennas through multiple superstrates". *IEEE Transactions on Antennas and Propagation*, ap-35(7), pp. 860-863.
Zhao, Tianxia, et al (2004). "Simple CAD model for a dielectric leaky-wave antenna". *IEEE Antennas and Wireless Propagation Letters*, 3, pp. 243-245.
Zhao, Tianxia, et al (2005). "2-D periodic leaky-wave antennas—Part I: Metal patch design". *IEEE Transactions on Antennas and Propagation*, 53(11), pp. 3505-3514.
Zhao, Tianxia, et al. (2005). "2-D periodic leaky-wave antennas—Part II: Slot design". *IEEE Transactions on Antennas and Propagation*, 53(11), pp. 3515-3524.
Jackson, David R. and Oliner, Arthur A. (1988). "A leaky-wave analysis of the high-gain printed antenna configuration". *IEEE Transactions on Antennas and Propagation*, 36(7), pp. 905-910.

(Continued)

*Primary Examiner* — Hoang V Nguyen
(74) *Attorney, Agent, or Firm* — Marcus C. Dawes; Daniel L. Dawes

(57) ABSTRACT

An apparatus, system, and/or method for a single planar feeding structure or antenna that may be integrated with one or more other system blocks is provided. The antenna may provide high radiation gain due to a large number of the radiating elements, which may be represented by one or more periodic openings or slots in a partially reflective surface (PRS). A feed network for the antenna may be provided by a wave bouncing between a ground plane and the PRS. The feed may be substantially in air, thereby suffering little to no loss. The fabrication process and/or method for the antenna is simple and low-cost. In one embodiment, the antenna may be formed at least in part by micromachining. The antenna may be designed at least in part using the Fabry-Pérot Cavity (FPC) method.

18 Claims, 31 Drawing Sheets

(56) References Cited

OTHER PUBLICATIONS

Jackson, D.R., et al. (1993). "A leaky-wave propagation and radiation for a narrow-beam multiple-layer dielectric structure". *IEEE Transactions on Antennas and Propagation* 41(3), pp. 344-348.

Lovat, Giampiero (2006). "Fundamental properties and optimization of broadside radiation from uniform leaky-wave antennas". *IEEE Transactions on Antennas and Propagation*, 54(5), pp. 1442-1452.

A.A. Oliner and D.R. Jackson, "Leaky-wave antennas" in J.L.Volakis (Ed.), Antenna Engineering Handbook. New York, NY: McGraw-Hill, 2007, 4th Edition, Ch. 11.

D. R. Jackson and A. A. Oliner, "Leaky-wave antennas", in C. A. Balanis (Ed.), Modern Antenna Handbook. New York, NY: Wiley, 2008, Ch. 7.

Lovat, Giampiero, et al (2006). "Bandwidth analysis of highly-directive planar radiators based on partially-reflecting surfaces". *EuCAP* 2006, pp. 1-6.

Zhao, Tianxia, et al. (2005). "General formulas for 2-D leaky-wave antennas". *IEEE Transactions on Antennas and Propagation*, 53(11), pp. 3525-3533.

Hosseini, S. A., et al. (2009). "Design of a single-feed all-metal 63 GHz Fabry-Perot cavity antenna using a TL and a wideband circuit model". *Antennas and Propagation Society International Symposium. APSURSI* '09. *IEEE*, pp. 1-4.

Hosseini , S. A., et al. (2009) "*Design of a single-feed 60 GHz planar metallic Fabry-Perot cavity antenna with 20 dB gain* " Antenna Technology, 2009. iWAT 2009. IEEE International Workshop on. pp. 1-4.

Garelli, R., et al. (2006) "Array thinning by using antennas in a Fabry-Perot cavity for gain enhancement". *IEEE Transactions on Antenna and Propagation*, 54(7), pp. 1979-1990.

Hosseini , S. A., et al. (2010). "Single-feed highly-directive Fabry-Perot cavity antenna for 60 GHz wireless systems; Design and fabrication". *Antennas and Propagation Society International Symposium (APSURSI)*, pp. 1-4.

* cited by examiner

LOW-COST HIGH-GAIN PLANAR ANTENNA USING A METALLIC MESH CAP FOR MILLIMETER-WAVE FREQEUNCY THEREOF

FIELD OF THE INVENTION

The present invention relates generally to antennas for wireless systems, and more particularly, to a low cost, high gain planar antenna.

BACKGROUND

High-gain antennas for millimeter-wave (MMW) applications may be designed in the various forms such as non-planar (e.g. array of openings (slots) in a side wall of a waveguide or horn antennas) or planar antennas (e.g. an array of periodic printed patches or slots).

A non-planar (e.g. horn) antenna may provide a high radiation gain, at the expense of its size. The horn antenna may be difficult to integrate with other planar sub-systems due to size constraints. To achieve the same maximum gain, the horn antenna's dimensions decreases as frequency of operation is increased; this adds complication to the fabrication process since connectors of the antenna require high precision machining which is very expensive. Also, the excitation of non-planar antennas (e.g. horn antennas) becomes challenging at high frequencies.

Considering planar antennas, to achieve high radiation gain, an array of microstrip or slot antennas printed on a planar substrate may be used. For planar array antennas, each element must be fed separately. One drawback of such antennas is designing and tuning the complex feeding network. To limit the associated losses of a feeding network, a low-loss substrate should be used which may be expensive.

Low-loss substrates for printed structures operating at MMW frequencies, such as 60 GHz and above, are very expensive, and the feed network to excite such a large array (in order to provide high radiation gain) is bulky, thereby increasing the overall size of the array, dielectric loss, and ohmic loss.

Therefore, there is a need for a planar antenna that may be integrated with and fabricated as part of PCB, while overcoming the aforementioned drawbacks and shortcomings.

SUMMARY

Broadly, in one aspect, a wireless antenna system is disclosed that includes a ground plane, a frequency selective surface (FSS) including a plurality of slots and covering at least a portion of the ground plane to form a cavity, a planar antenna configured to feed the cavity, and a coplanar waveguide configured to feed the antenna. The system may operate at a frequency of at least about 57 GHz or at millimeter-wave frequencies. The length and/or the width of the slots are varied to achieve a predetermined gain. Further, the antenna is configured to resonant at or about the central frequency of the cavity.

The FSS may include at least two layers. In one embodiment, the FSS may include at least approximately equal size layers divided approximately equally over a feeding point of the cavity.

BRIEF DESCRIPTION OF THE DRAWINGS

FIG. 3(*b*) illustrates a FPC antenna without a FSS layer in an embodiment.

FIG. 3(*c*) illustrates a slot on the FSS layer and a shape of a cavity in an embodiment.

FIG. 3(*d*) illustrates a Bowtie slot antenna fed by a CPW 50 Ohm line in an embodiment FIG. 3(*e*) illustrates a CPW propagation mode in an embodiment.

FIG. 25(*b*) illustrates a multi-level FSS in a 3D view in an embodiment.

FIG. 25(*c*) illustrates a zoomed view of two lateral sections with dimensions of the slots in each section in an embodiment.

DETAILED DESCRIPTION

Figure 1:
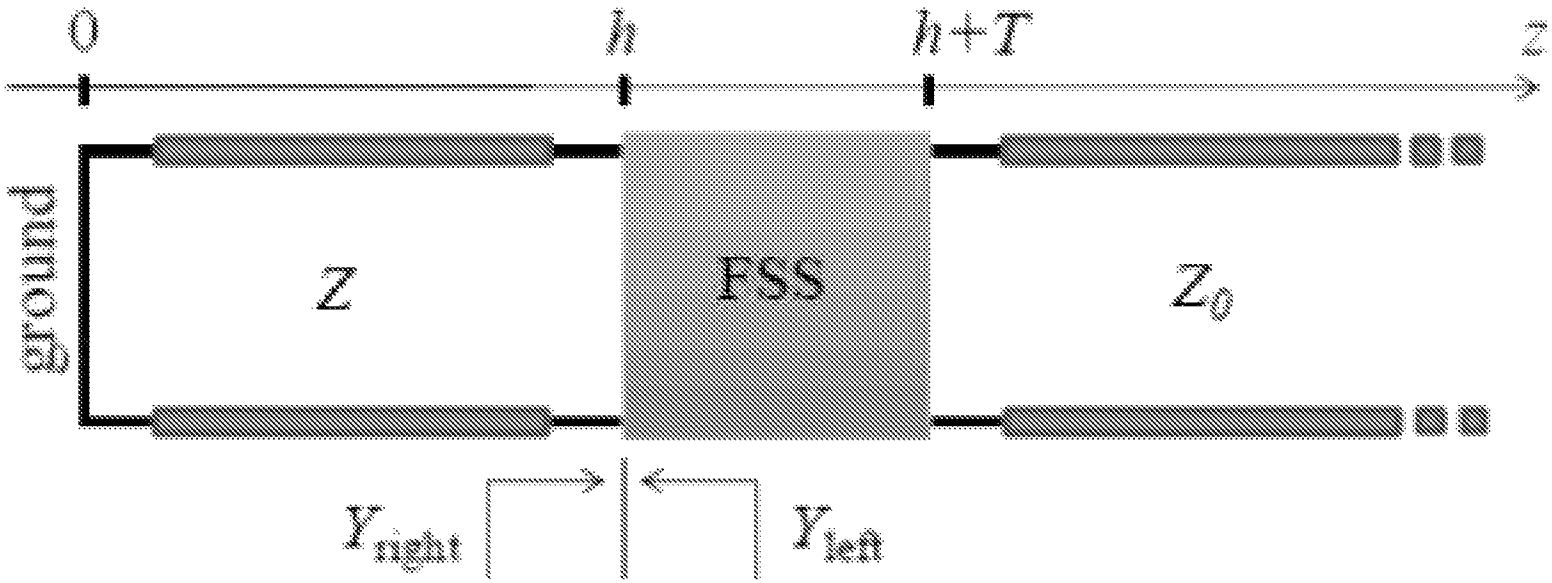
FIG. 1 illustrates a Transmission Line (TL) model for a Fabry-Pérot cavity (FPC) antenna covered by a thick Frequency Selective Surface (FSS) in an embodiment.

An apparatus, system, and/or method for a single-feed planar antenna that may be integrated with one or more other system blocks on a PCB is provided. In one embodiment, the antenna may provide high radiation gain due to a large number of the radiating elements, which may be formed as layer of thick metallic (thick in comparison with the wavelength of the operating frequency of the antenna) sheet/plane with periodic openings or slots known as a frequency selective surface (FSS) or generally known as a partially reflective surface (PRS).

A feed network for the antenna may be provided by a wave bouncing between a ground plane and the PRS. The feed may be substantially in air, thereby suffering little to no loss. The fabrication process and/or method for the antenna is simple and low-cost. In one embodiment, the antenna may be formed at least in part by micromachining.

In one embodiment, the antenna may be designed at least based on the Fabry-Pérot Cavity (FPC) concept by placing a PRS on top of a ground plane. By feeding the cavity, Leaky-Waves (LW) may propagate inside the cavity between the ground plane and the PRS. The cavity may be excited or fed in or about the middle of the cavity. In other embodiments, the cavity may be excited at the sides or anywhere under the FSS.

The excited LWs bounce back and forth inside the cavity and will leak power away through the PRS and attenuate, while traveling inside the cavity away from the feeding point. At or about the resonance frequency of the FPC antenna, the radiation through the PRS may have the same or substantially same phase distribution. Accordingly, the antenna may radiate with a maximum gain or substantially maximum gain at broadside, i.e., normal to the antenna's surface or substantially close to broadside. Reflectivity of the PRS may determine a maximum radiation gain of the antenna along with a 3 dB power bandwidth. This may be defined as a frequency range within which the broadside radiation power remains in 3 dB level of a maximum power.

In one embodiment, the PRS may be formed at least in part of a thick metallic mesh cap to provide mechanical stability. Other similar materials such as aluminum may be used. The cap may be placed over some or all of the ground plane at a distance such that the cavity may resonate at a desired frequency. In one embodiment, the PRS may be supported at least in part by four metallic poles at the four corners of the PRS or may be covered by a solid wall on each side. A feed line may be configured to excite the antenna cavity, and/or to couple the antenna to other parts of one or more circuits on a PCB.

The antenna may operate in wide range of frequency bands including millimeter-wave frequencies from approximately 57 GHz to 64 GHz, based on the US FCC regulation). The antennae may be configured for high-rate data transmission, such as multi Gigabits per second. Accordingly, the antennae may be configured to support applications, such as movie download, remote storage, wireless video connection and the like. The antennae may be configured for use with mobile devices, laptops, Personal Digital Assistants and similar devices and support any number of wireless standards including ECMA TC48 and IEEE 802.15.3c)

Due to high atmospheric absorption loss at certain frequencies, such as 60 GHz, there is less interference between multiple wireless systems. This reduces the need for complicated coding algorithms. Based on Friis equations, 60 GHz wireless systems may have about 22 dB more path-loss as compared to wireless systems that operate at approximately 5 GHz. The antennas used in 5 GHz wireless systems are designed to radiate approximately or close to 0 dB gain. At a higher operating frequency, such as 60 GHz, the antennas may be designed to have around 10-11 dB broadside radiation gain, assuming that the transmit and receive antennas as substantially the same.

In one embodiment, a line-of-sight may be provided between a transmit and receive antenna. In one embodiment, broadside radiation gain behavior may be measured by the 3 dB pattern bandwidth of the antenna. As discussed herein, the pattern bandwidth of the antenna or 3 dB pattern bandwidth may be the frequency range within which the broadside radiation gain of the antenna remains in 3 dB level of the maximum broadside gain of the antenna.

In yet another embodiment, the antenna may include a cavity at least partially covered by a relatively thick frequency selective surface (FSS) layer made of brass, aluminum, or similar materials. The FSS layer may include periodic slots which are made using micro-machining. The number of slots may vary. The length and/or width of the slots may be designed for a desired gain. In one embodiment, smaller slots (in length) may be used to provide a highly reflective FSS layer, which results in a high radiation gain. In one embodiment, the gain may be 10 dB or higher. In one embodiment, the cavity may be fed by a slot bowtie antenna which is fed by a 50 Ohm CPW line. The bowtie antenna may be used to enhance the impedance bandwidth of the antenna. The bowtie antenna and the CPW line may be designed on a thin copper layer over a Roger-5880 substrate.

The total bandwidth of the antenna may depend on an impedance and pattern bandwidths. For a FPC antenna, the maximum directivity of the antenna may be inversely proportional to the 3 dB pattern bandwidth of the antenna. This means the higher the maximum directivity of the antenna, the less the 3 dB pattern bandwidth. In one embodiment, the antenna may be designed using Ansoft HFSS and CST Microwave Studio programs. In one embodiment, the antenna may be designed to achieve maximum gain at a central frequency of the antenna.

FIG. 1 shows the Transmission Line (TL) model of a FPC antenna covered at least in part by a thick FSS. A thick FSS may change for different thicknesses and materials. The antenna may be represented by a general 2-port network where $Z_0=Y_0^{-1}=\sqrt{\mu_0/\epsilon_0}$ and $Z=Z_0\sqrt{\mu_r/\epsilon_r}=Z_0\eta_r$. h may represent the resonance height of the cavity at the central frequency of the antenna and T may represent the thickness of the FSS layer. At the resonance frequency of the antenna, the total imaginary admittance $B_{tot}=Y_{right}+Y_{left}$ calculated at interface between FSS layer and the cavity, as shown in FIG. 1, goes to zero which results in resonance height of the cavity h. The leftward admittance is equal to the admittance of a shorted transmission line with the length of h which may be calculated as $$Y_{left}=jY\cot(k_{op}h) \tag{1}$$

where $k_{op}=\omega_{op}\sqrt{\mu_0\epsilon_0}$ and $\omega_{op}$ is the operating frequency of the antenna. The rightward admittance ($Y_{right}$) may represent the function of the two-port network of the FSS layer. In another embodiment, using a full-wave simulation tool (i.e. HFSS), scattering matrix modeling an arbitrary FSS may be calculated for different types and thicknesses of the FSS (by modeling an infinite FSS using periodic boundaries). Then, using the Transmission Line equations, ($Y_{right}$) may be calculated as a function of Y-matrix element of FSS as $$Y_{right} = Y_{11} - \frac{Y_{21}Y_{12}}{Y_0 + Y_{22}} = Y_{11} - \frac{Y_{12}^2}{Y_0 + Y_{11}} = Y_0(\hat{g} + j\hat{b}) \tag{2}$$

Thus using (1) and (2), by setting B=0, the resonance height of the antenna h may be calculated at its central frequency as $$h = \frac{1}{k_{op}}\cot^{-1}(\eta_r\hat{b}) \tag{3}$$

An external source, such as a coax cable or a waveguide may be adapted to excite the cavity. A planar feeding structure, such as a CPW-line fed slot dipole, may also be used. The feed may be used to improve bandwidth enable radiating with an acceptable gain inside the cavity. Accordingly, in one embodiment as shown FIG. 2, a slot Bowtie antenna may be used for the feeding structure.

Figure 2:
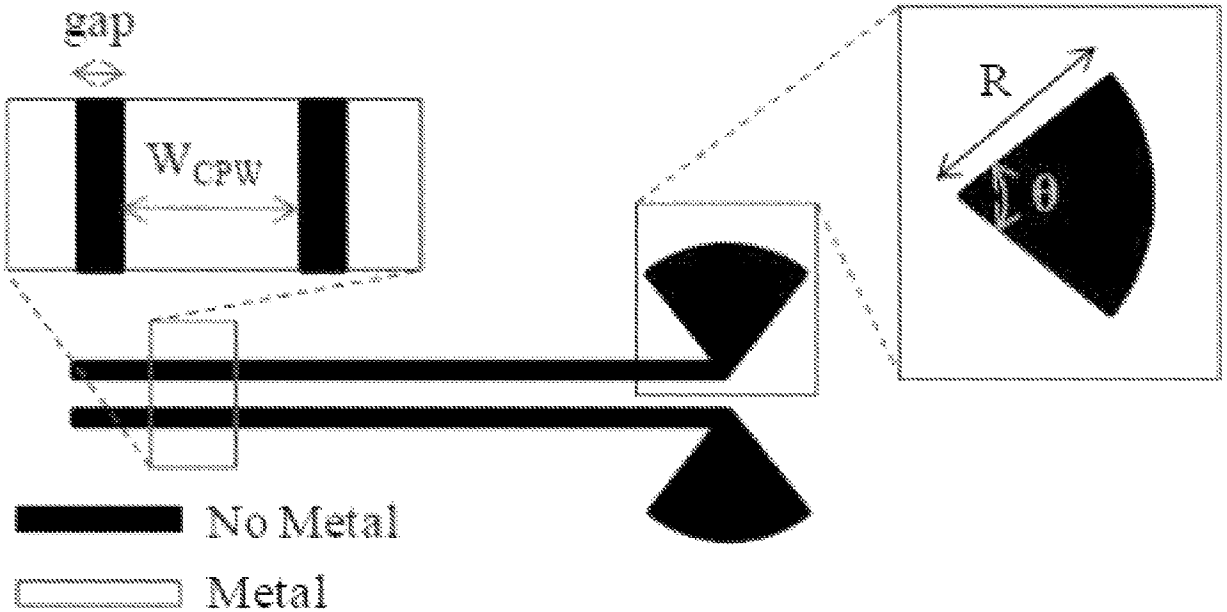
FIG. 2 illustrates a planar feeding structure of a FPC antenna in an embodiment.

As discussed above, the input impedance of the antenna is a function of the feeding structure. In one embodiment, the CPW line may be designed to be a 50 Ohm line at the central frequency of the antenna. As shown in FIG. 2, a gap of CPW line may be selected to be 50 μm and width of line may be selected to be 600 μm. The Bowtie slot antenna may be configured to resonate at the central frequency of the cavity and to be matched with the 50 Ohm CPW line in antenna's frequency band. As shown in FIG. 2, R is designed to be 1.9 mm and the angle θ is selected to be 25 degrees.

The feeding structure may be fabricated on a 0.25 mm thick Rogers/5880 ($\epsilon r$=2.2 and tan δ=0.002) substrate with copper only on the top side having thickness of about 18 μm. It also should be mentioned that the bowtie slot antenna radiates both upward into the cavity and downward into the substrate. As the permittivity of the substrate increases, there is more directivity of the pattern toward the substrate. In one embodiment, a substrate may be selected with a minimal possible permittivity and low-loss at millimeter-wave frequencies.

Figure 3:
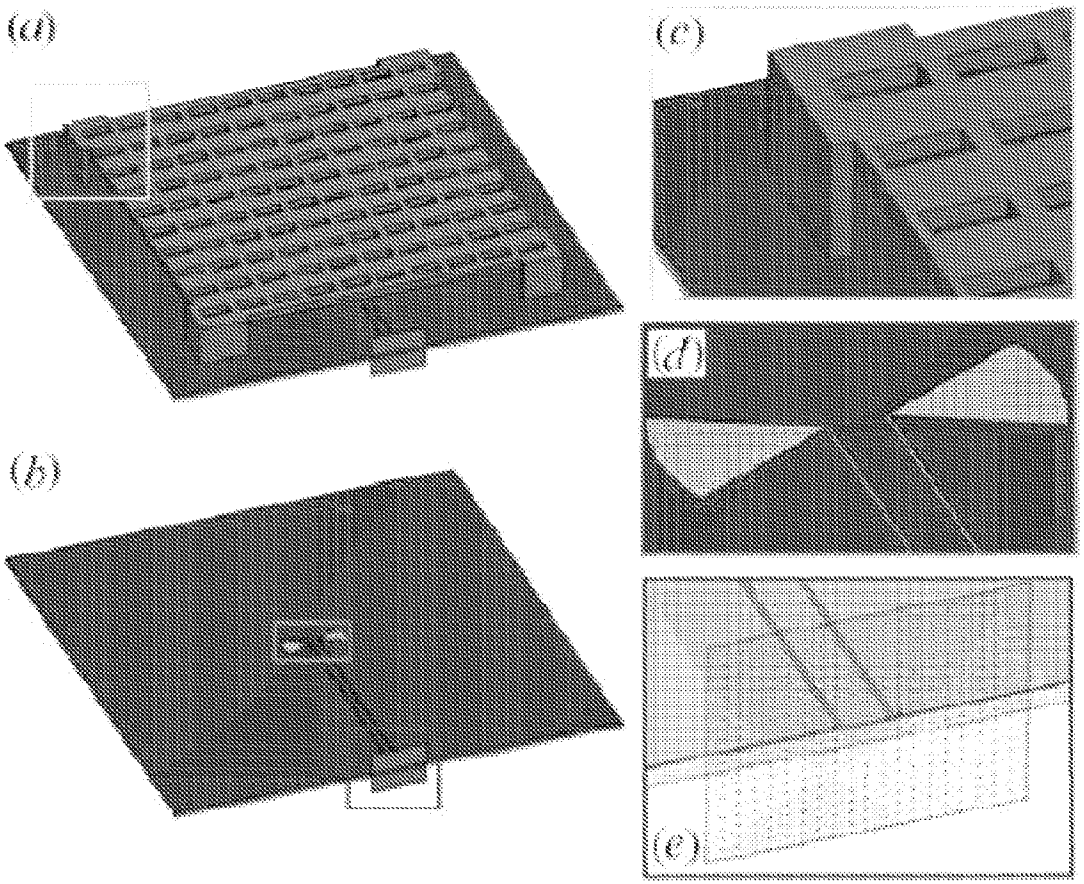
FIG. 3(*a*) illustrates a FPC antenna fed by a slot Bowtie antenna in an embodiment.

FIGS. 3(*a*)-3(*e*) illustrate the antenna's structure and feeding network in an embodiment.

As shown in FIG. 3(*c*), the FSS layer may be suspended above the bowtie antenna with supporting legs made of brass. The FSS may be separated from the feed by a distance of h which is the resonance height of the antenna. The bowtie antenna, as shown in FIG. 3(*d*), may be configured as a slot antenna. Accordingly, the metallic layer around the feed may act as a ground plane of the cavity. The substrate may have a thickness of about 0.5 mm and is not grounded to support the CPW-mode, as shown in FIG. 3(*e*).

The antenna may be designed with three different FSS layers. The high-gain antenna, with the resonance height of h=2.3 mm, may be designed with FSS layers made of periodic slots (length=1.9 mm and width=0.8 mm) which radiates with approximately 19 dB broadside directivity. The mid-gain antenna may be designed with FSS layers made of brass and periodic slots (length=2.08 mm, width=0.8 mm and square unit-cell with size of 2.5 mm) with resonance height of h=2.2 mm. In this embodiment, the antenna radiates around 15 dB maximum directivity. The low-gain antenna is a FPC antenna covered by a FSS layer made of periodic slots (length=2.3 mm, width=0.8 mm and also square unit-cell with size of 2.5 mm) with resonance height of h=1.93 mm. In this embodiment, the antenna radiates around 9.5 dB maximum directivity.

The design parameters ($\hat{b}$ and $\hat{g}$) of the FPC antennas, covered by a thick FSS, may be calculated using equation (2) above. Using the full-wave simulations, the design parameters of the high-gain FPC antenna may be calculated as ($\hat{b}$=4.111 and $\hat{g}$=0.528). The mid-gain and low-gain FPC antennas may be found as ($\hat{b}$=2.58 and $\hat{g}$=0.641) and ($\hat{b}$=1.138 and $\hat{g}$=0.830). The antenna may include an array of 10×10 slots.

Figure 4:
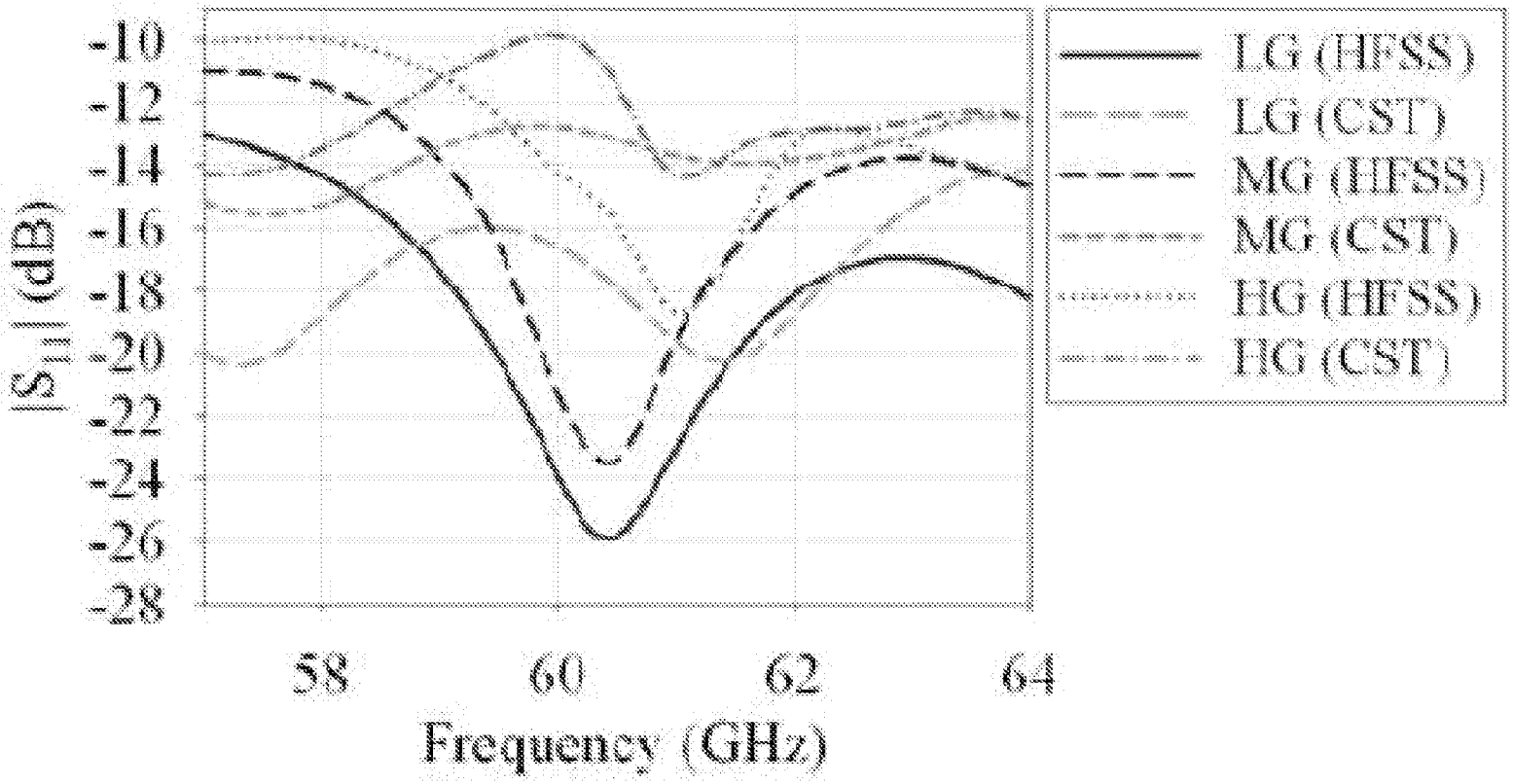
FIG. 4 illustrates a reflection coefficient of FPC antennas.

FIG. 4 shows the magnitude of reflection coefficient of designed FPC antennas including a comparison among the designed high-gain, mid-gain and low-gain antennas versus frequency by both HFSS and CST. In this embodiment, the designed antennas are matched to the 50 Ohm feed in the operational frequency. There may be a small shifting in frequency behavior of the reflection coefficient of the antenna between HFSS and CST.

Figure 5:
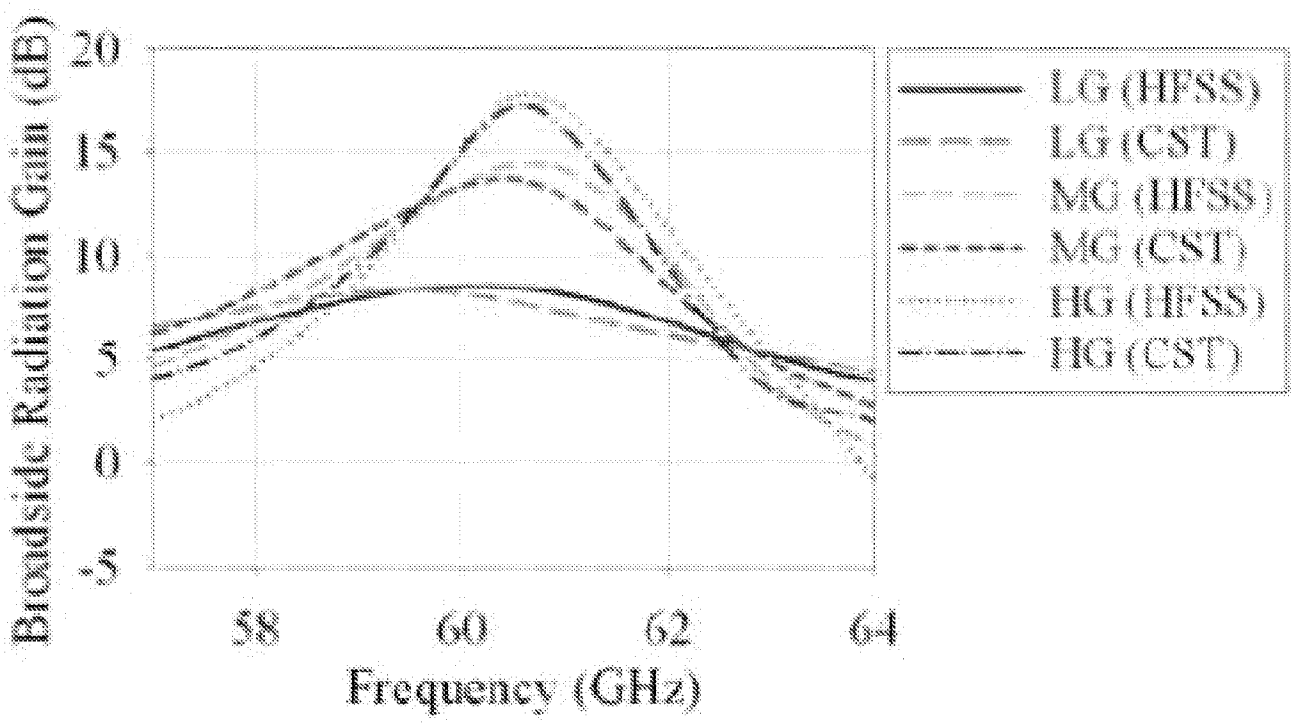
FIG. 5 illustrates a broadside radiation gain of FPC antennas.

FIG. 5 shows the broadside realized radiation gain of FPC antennas (High-gain, mid-gain and low-gain) versus frequency by both HFSS and CST. In one embodiment, the central frequency of the antenna (resonance frequency) may be about around 60.5 GHz with the maximum gain of about 18 dB. The 3 dB pattern bandwidth of the antenna may be around 1.4 GHz.

Figure 6:
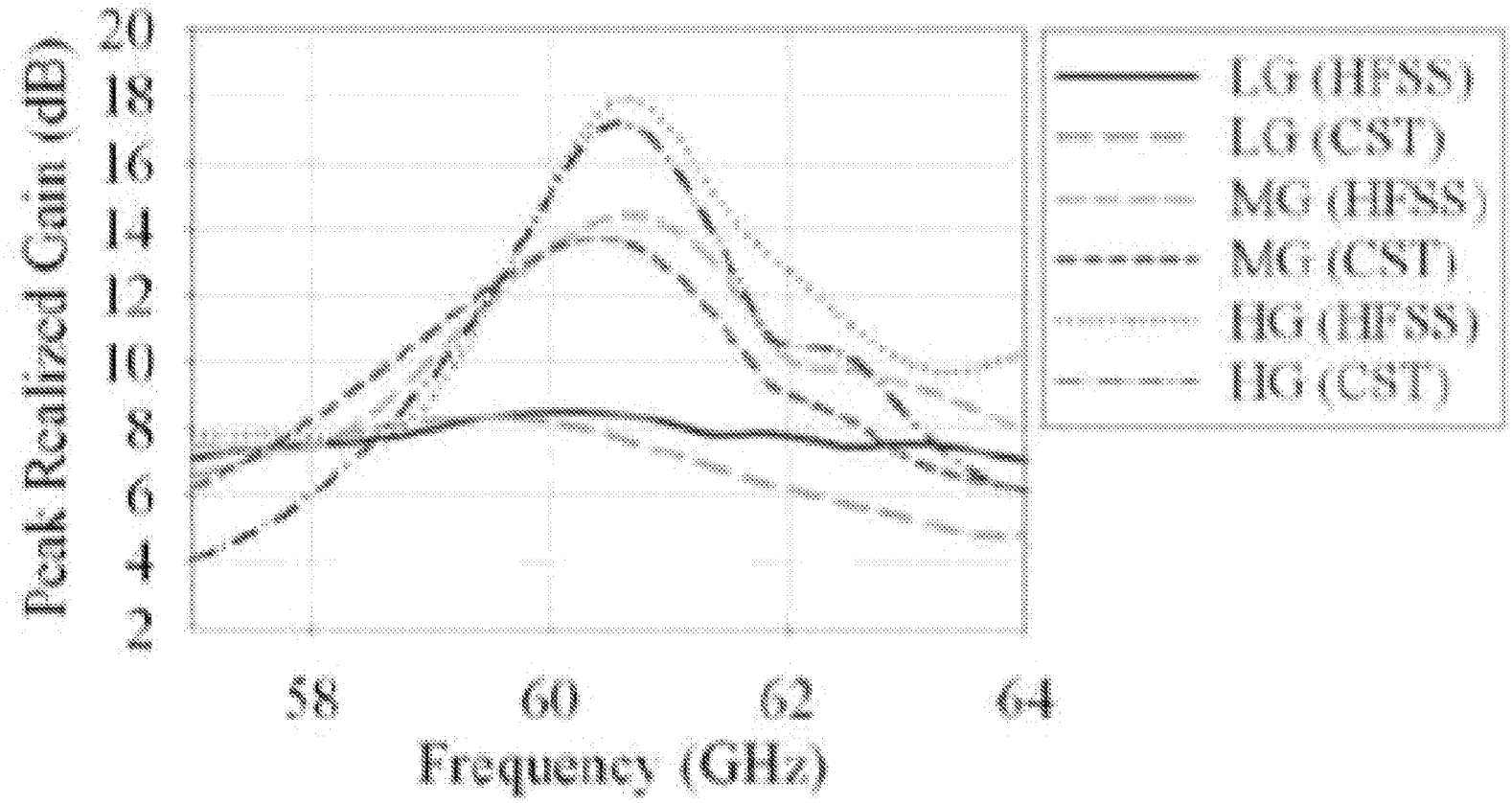
FIG. 6 illustrates a peak realized radiation gain of the FPC antennas versus frequency.

As shown in FIG. 5, the maximum gain of the mid-gain antenna may be approximately 14.5 dB at 60.5 GHz and the 3 dB pattern bandwidth of the antenna may be around 2.2 GHz. The low-gain antenna, as shown in FIG. 5, may have a maximum gain of about 8.5 dB at 60 GHz, and the 3 dB pattern bandwidth may be around 5.75 GHz. In an embodiment, the 3 dB pattern bandwidth of the antennas may be controlled and/or limited. Further, by increasing the maximum gain of the antenna, the pattern bandwidth may decrease FIG. 6 illustrates the peak realized gain of the FPC antennas versus frequency. As shown, the peak realized gain, at the resonance frequency of the antenna, may be about the same as the maximum broadside gain of the antennas, as seen in FIG. 5. This is because for a FPC antenna, the maximum gain is at the resonance frequency of the antenna and also at broadside.

Figure 7:
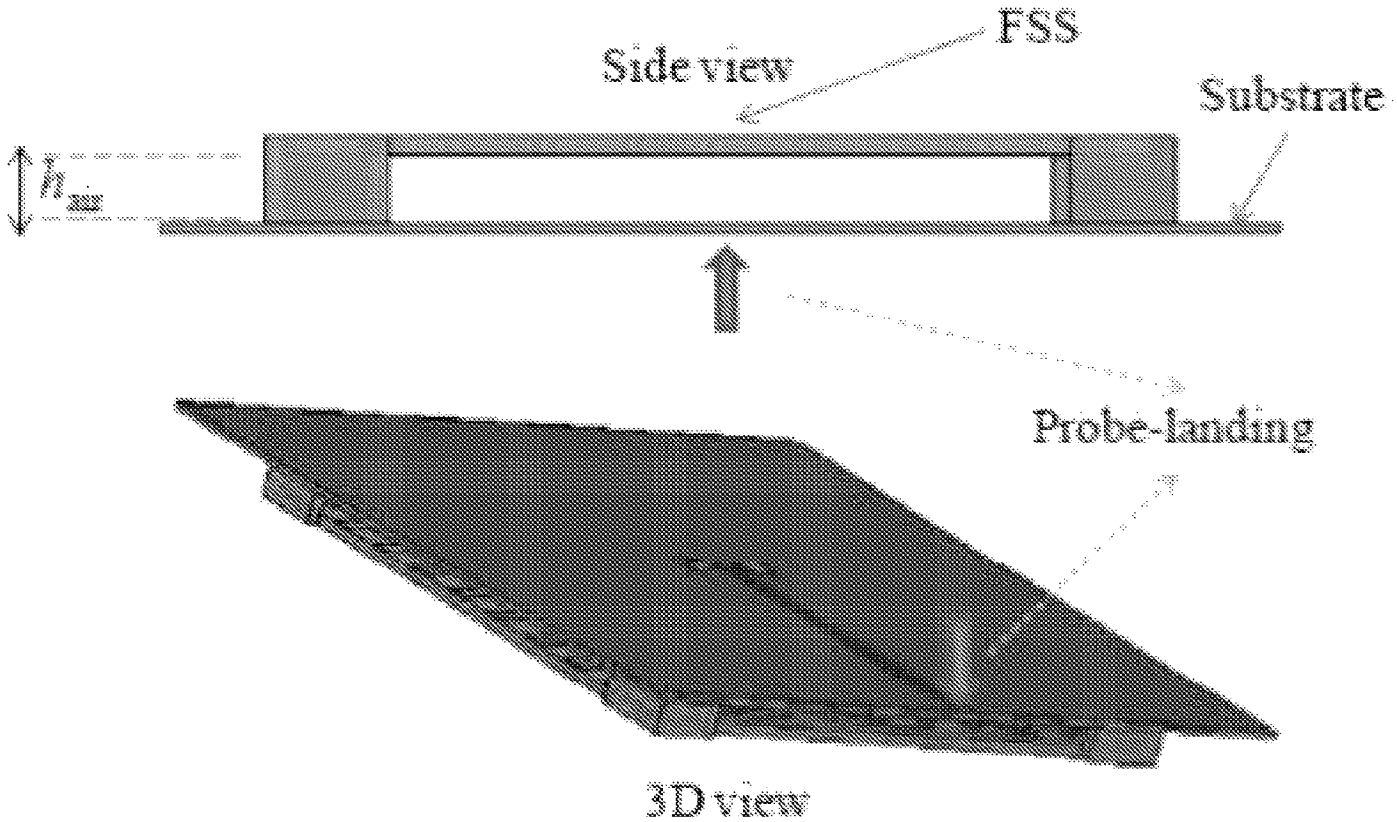
FIG. 7 illustrates a side and 3D views an antenna fed from behind in an embodiment.

In an embodiment, the antenna may be fed or probed from the back, behind the radiator surface, as shown in FIG. 7. This may reduce the coupling effect between the probe-head and the radiator.

A metallic layer, as shown in FIG. 2, may be coupled under the substrate. In this configuration, the dielectric becomes part of the cavity material, and the cavity becomes partially air with the thickness of $h_{air}$ and partially dielectric with thickness of $T_{sub}$=250 μm.

Figure 8:
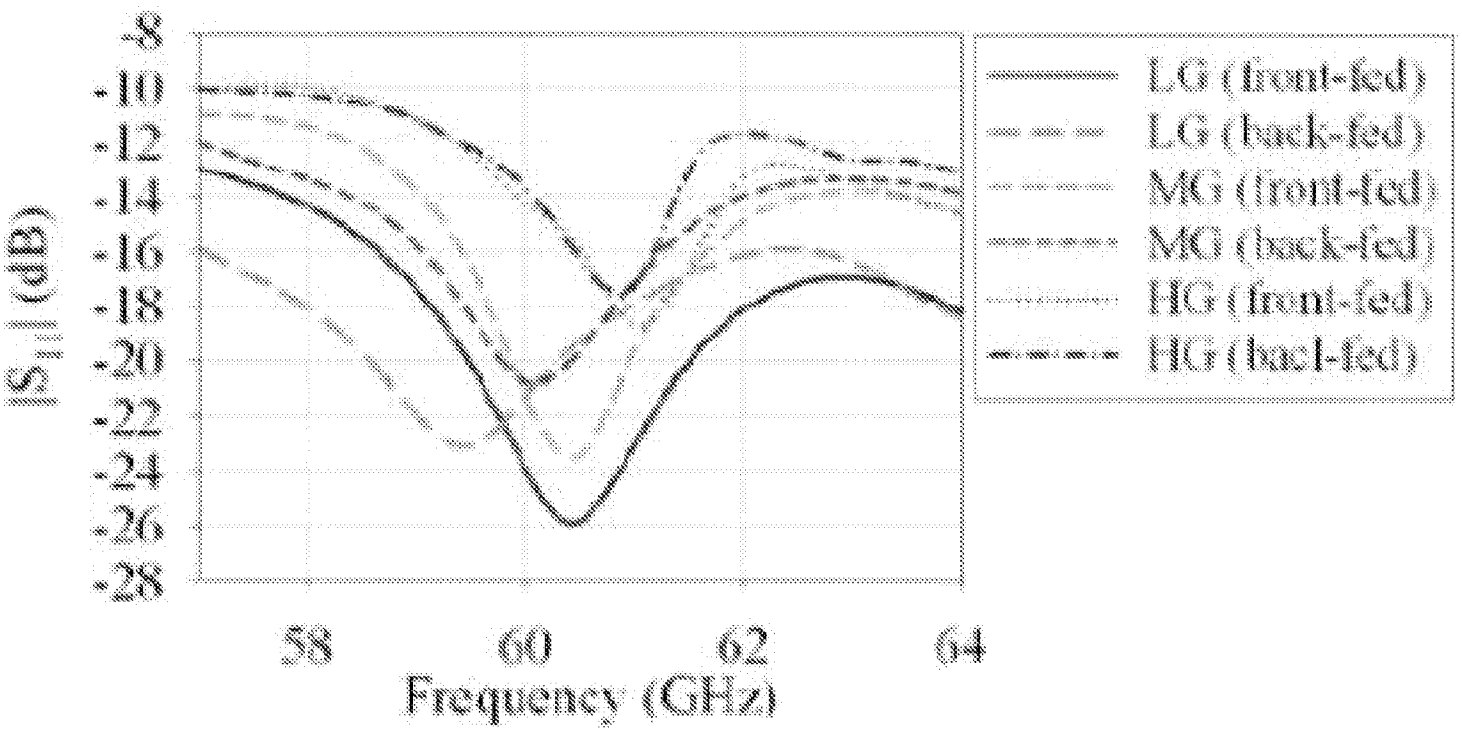
FIG. 8 illustrates a magnitude of a reflection coefficient of a back-fed FPC antenna in an embodiment.

FIG. 8 shows the reflection coefficient of Low-Gain (LG), Mid-Gain (MG) and High-Gain (HG) FPC antennas including a comparison between the front-fed and back-fed structures. As shown, the reflection coefficients of the antennas are almost identical for both front-fed and back-fed structures.

Figure 9:
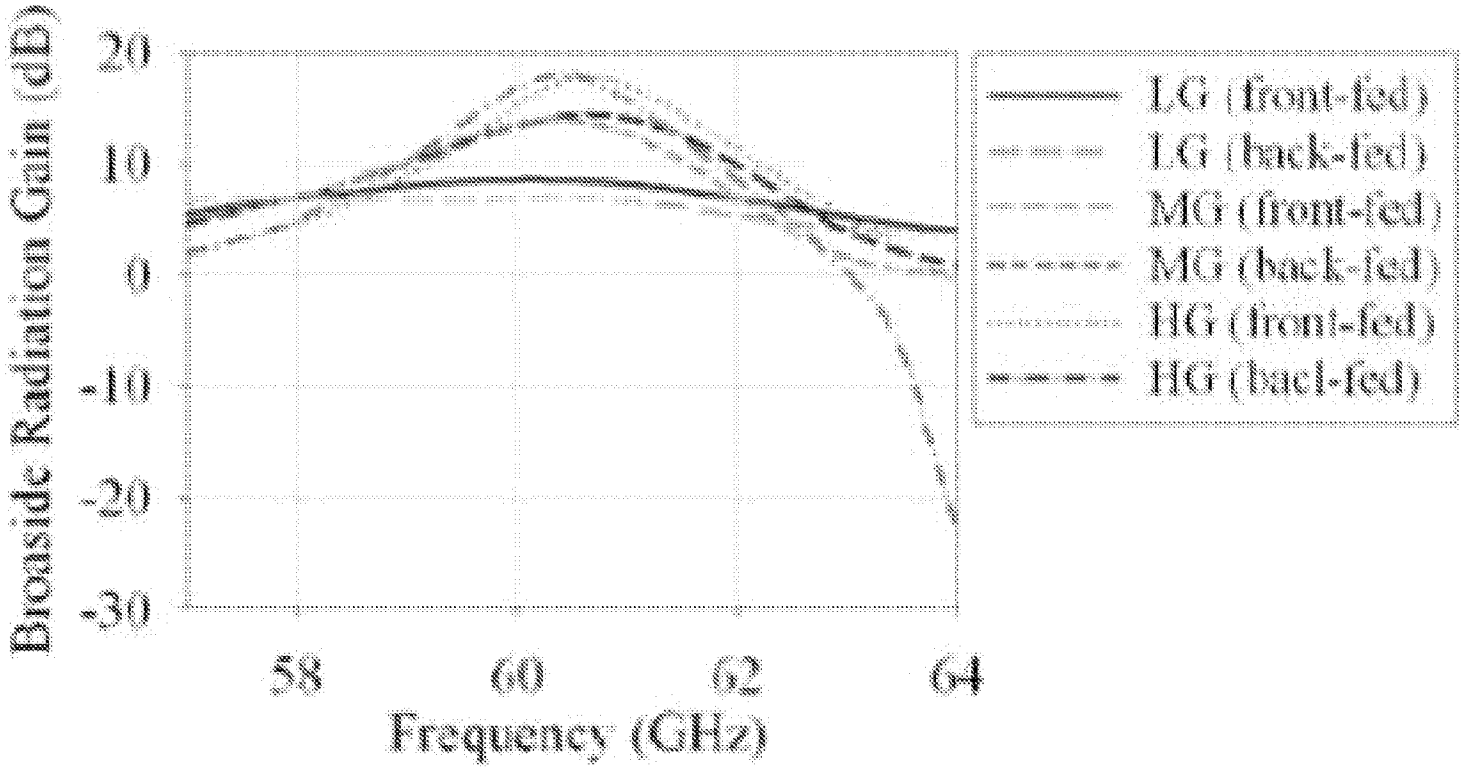
FIG. 9 illustrates a magnitude of broadside radiation gain of a back-fed FPC antenna in an embodiment.

FIG. 9 shows a comparison between the broadside radiation gain of both front-fed and back-fed FPC antennas for LG, MG and HG designs. Although there is a small shift in the broadside radiation gain of the antennas over frequency, their behavior remains almost similar. As shown in FIG. 9, the back-fed antenna may have a smaller 3 dB pattern bandwidth than a h front-fed antenna.

The pattern bandwidth of a FPC antenna covered by a thick FSS may be a function of two parameters ($\hat{b}$ and $\hat{g}$). For a fixed gain FPC antenna, e.g., mid-gain≈16.5 dB, the thickness of the FSS layer may be made of brass may be changed to determine the effects on the reflection coefficient and broadside gain bandwidth of the antenna. The FPC antenna may be covered by a finite size FSS of 10 by 10 and fed by a structure, as shown in FIG. 2.

TABLE I

DESIGN PARAMETERS OF FPC ANTENNAS, DESIGNED AT 60 GHZ, WITH THE SAME RADIATION GAIN FOR DIFFERENT FSS THICKNESS

| T (min) | $\hat{b}$ | $\hat{g}$ | Resonance Height (mm) |
|---|---|---|---|
| 0.05 (0.01 $\lambda_0$) | 3.757 | 0.9425 | 2.312 |
| 0.5 (0.1 $\lambda_0$) | 3.229 | 0.6032 | 2.261 |
| 0.75 (0.15 $\lambda_0$) | 2.915 | 0.4901 | 2.237 |
| 1 (0.2 $\lambda_0$) | 2.658 | 0.4147 | 2.214 |
| 1.5 (0.3 $\lambda_0$) | 2.259 | 0.3016 | 2.169 |

Table I shows the design parameters of FPC antennas with a same radiation gain, but different FSS thickness. It can be seen in Table I, by increasing the thickness of the FSS, $\hat{g}$ decreases. In the same way, b as well as the resonance height of the antenna decreases by increasing the thickness of the FSS layer.

Figure 10:
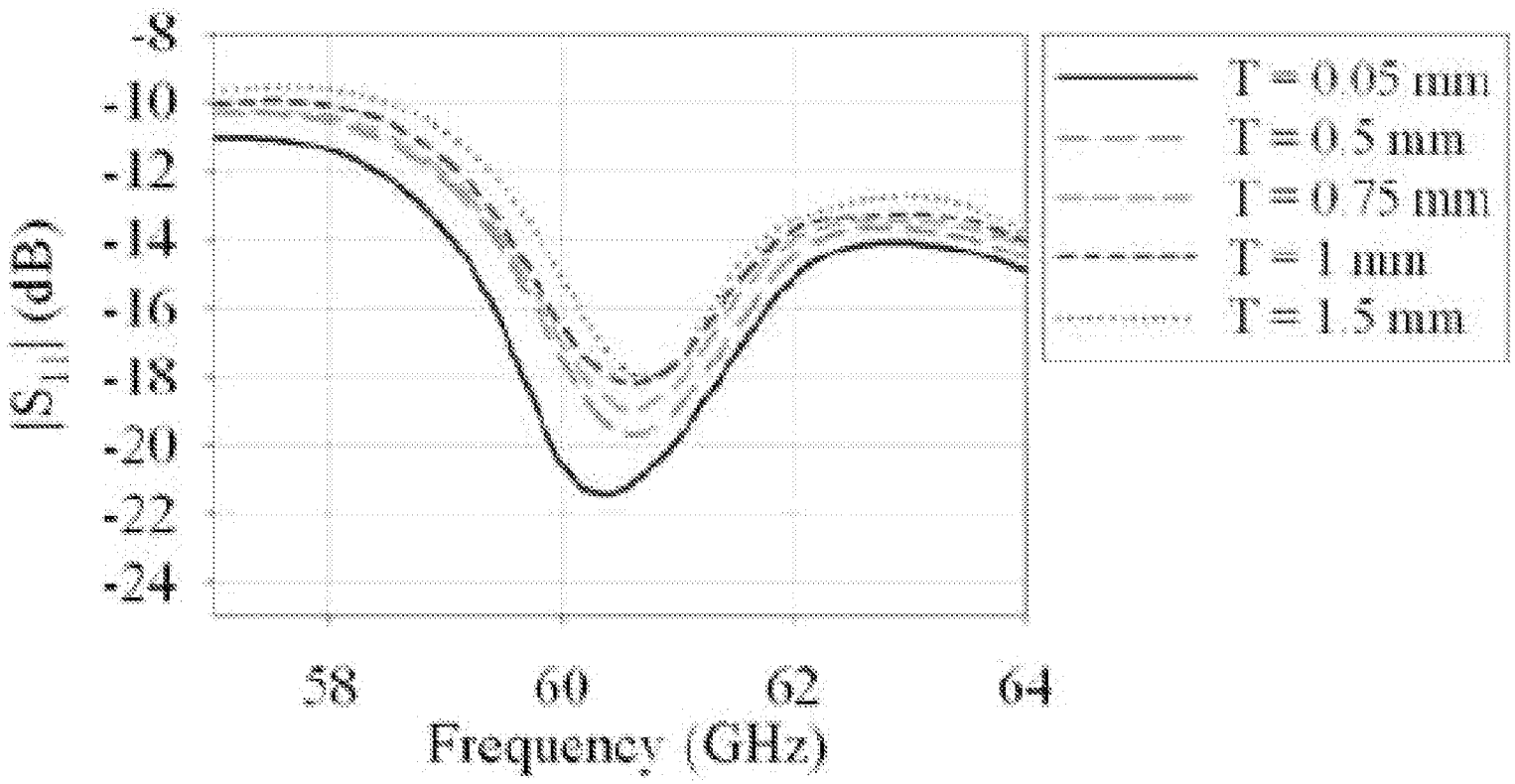
FIG. 10 illustrates a reflection coefficient of a mid-gain FPC antenna for varying thicknesses of FSS layers in an embodiment.
Figure 11:
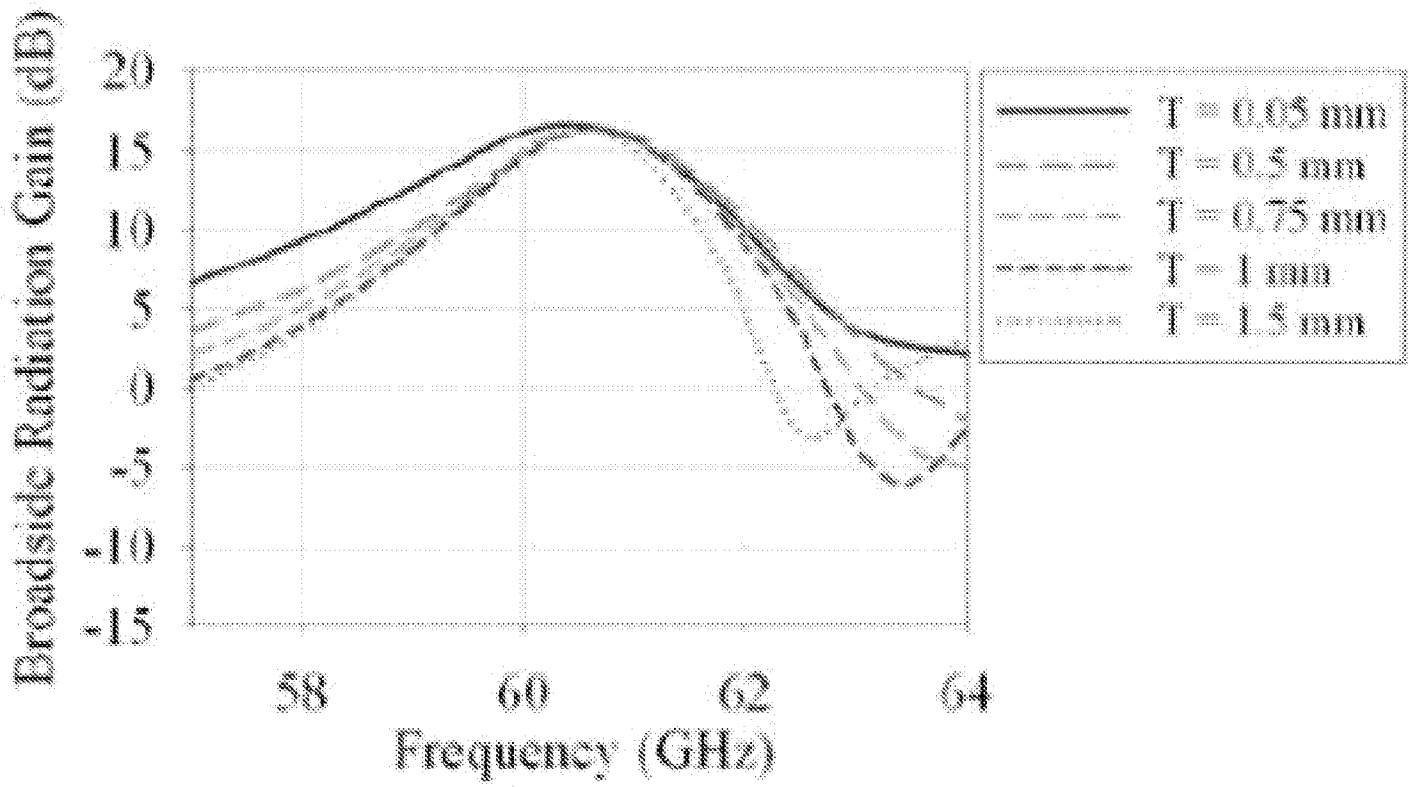
FIG. 11 illustrates a broadside radiation gain of FPC antennas for different FSS thickness values in an embodiment.

The simulated reflection coefficient and the broadside radiation (realized) gain of the antennas are shown in FIG. 10 and FIG. 11, respectively. It can be seen that by increasing the FSS thickness, the 3 dB pattern bandwidth of the antenna decreases.

Figure 12:
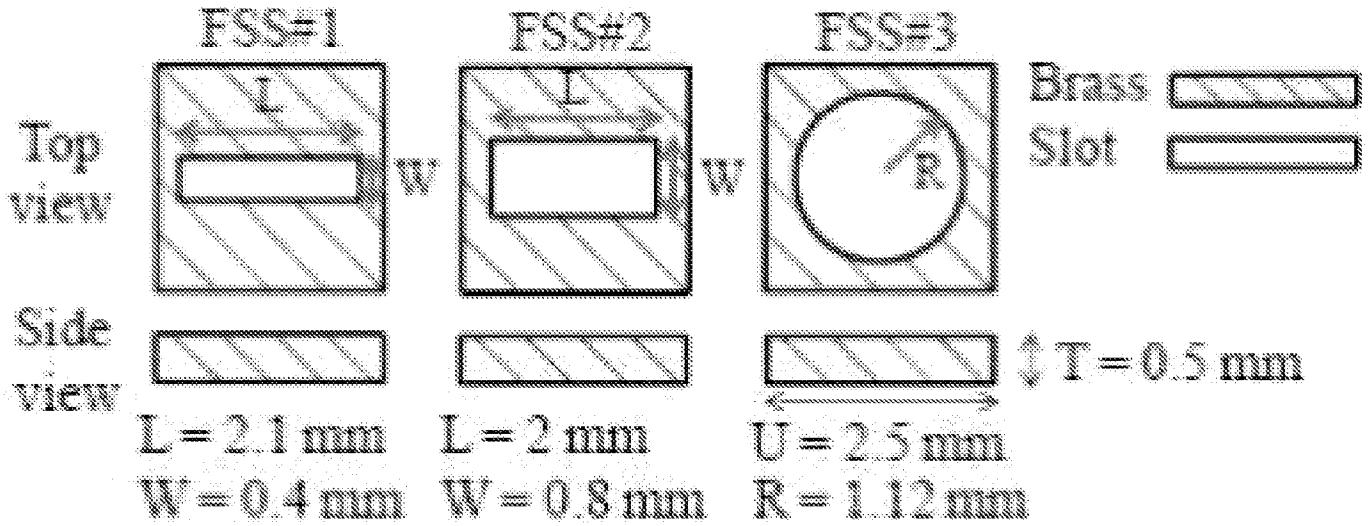
FIG. 12 illustrates a unit-cell of thick FSS layers made of brass to form a same gain FPC antennas in an embodiment.

Three different FSS unit-cells designed at 60 GHz which forms FPC antennas with the same radiation gains are shown in FIG. 12 with dimensions. Table II shows the design parameters of the FPC antenna covered by the FSS layers shown in FIG. 12.

Figure 13:
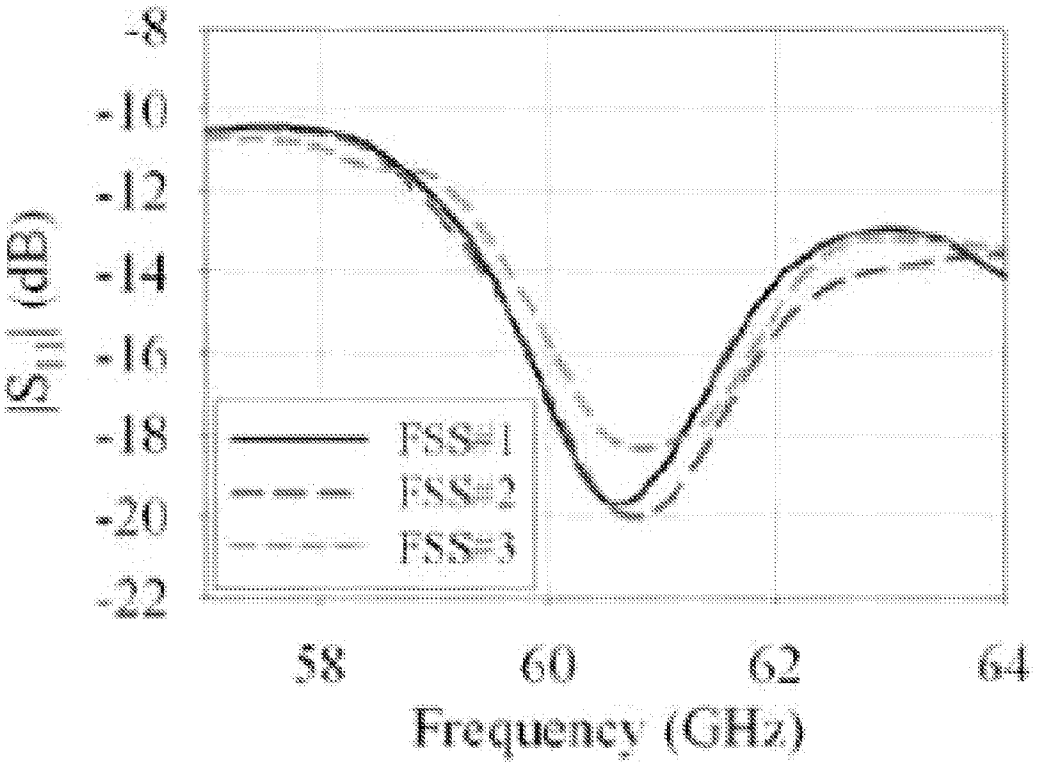
FIG. 13 illustrates a magnitude of a reflection coefficient of FPC antennas shown in Table II, simulated by HFSS.

It can be seen that, despite of forming the same-gain FPC antennas, different unit-cells have different design parameters as shown in Table II. FIG. 13 illustrates the magnitude of the reflection coefficients of the antennas covered by FSS layers shown in FIG. 12.

Figure 14:
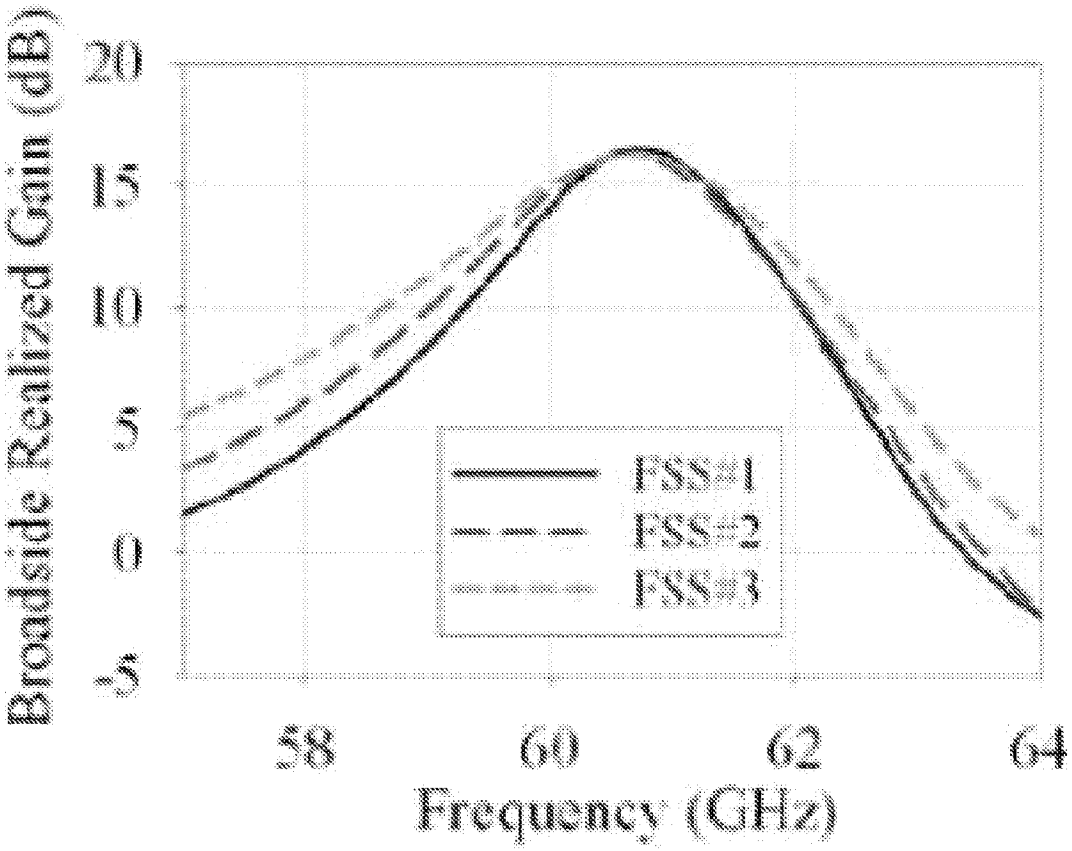
FIG. 14 illustrates a broadside radiation gain of FPC antennas covered by FSS layers shown in Table II.

FIG. 14 illustrates the broadside realized gain of the mentioned antennas. For different unit-cell, one can get the same maximum radiation gain, but different 3 dB pattern bandwidth which is function of both $\hat{b}$ and $\hat{g}$.

In one embodiment, the 3 dB pattern bandwidth of a FPC antenna covered by a FSS made of non-uniform slots may be enhanced.

Figure 15:
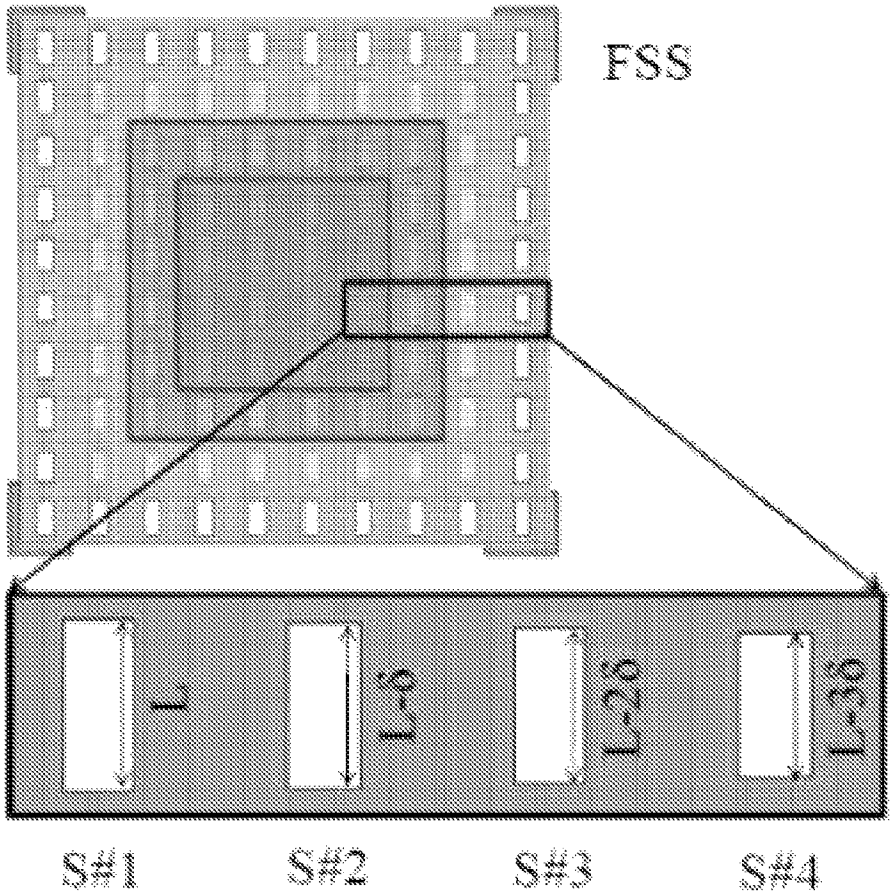
FIG. 15 illustrates a FSS layer with non-uniform slot distribution in an embodiment.

In this method, the slot dimensions may be changed by getting farther from the center of the antenna. By decreasing the length of the farther slots, the 3 dB pattern bandwidth may be improved. As shown in FIG. 15, the designed FSS layer is divided in four areas. It can be seen the central area has the designed slot length (L) but for other areas, the length of slot decreased by δ.

The introduced FSS layers discussed above may include; high-gain FPC antenna (L=1.9 mm) and h=2.31 mm, mid-gain FPC antenna (L=2.08 mm and h=2.206 mm) and low-gain FPC antenna (L=2.3 mm and h=1.926 mm). The comparisons are made among the uniform slot FSS layer and two different δ values (0.025 mm and 0.05 mm).

Figure 16:
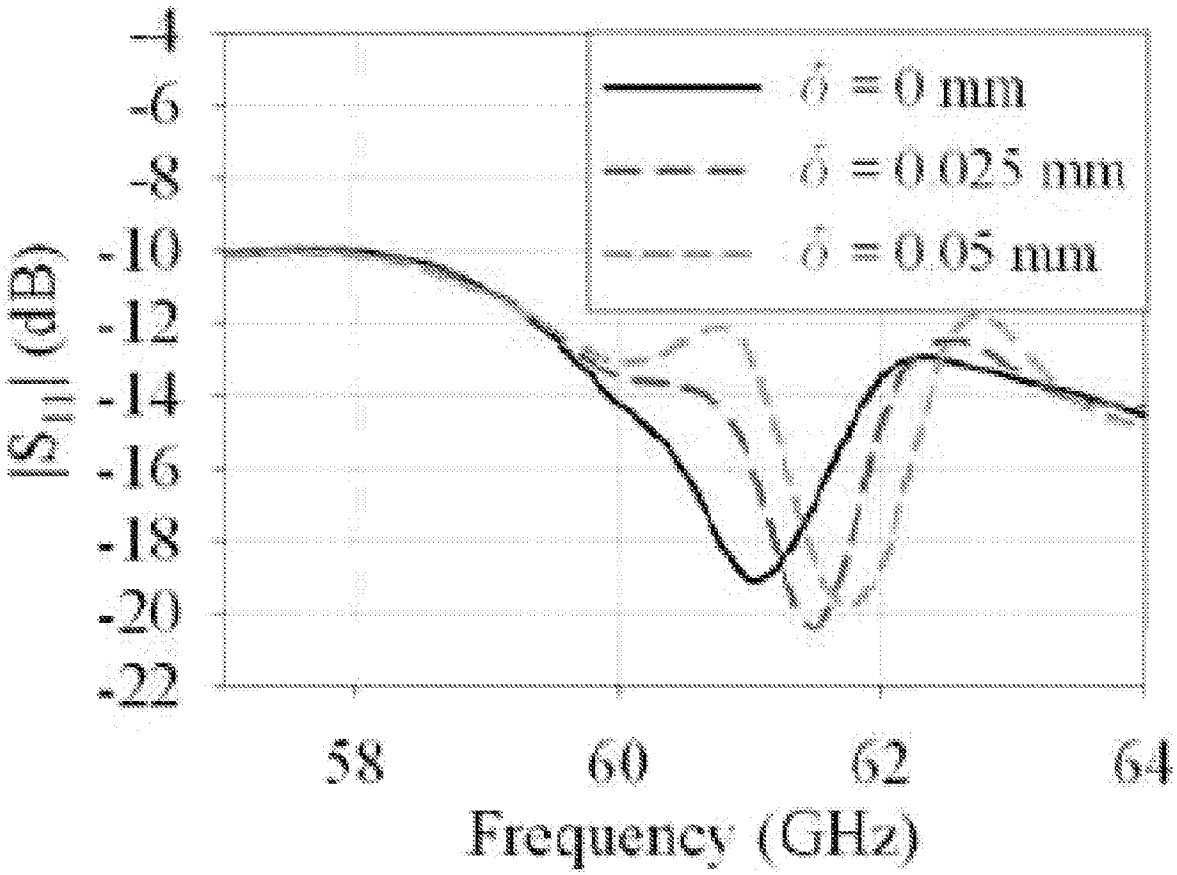
FIG. 16 illustrates a magnitude of a reflection coefficient of a high-gain FPC antenna with a comparison among different values of δ.

FIG. 16 shows the magnitude of the reflection coefficient of the high-gain FPC antenna including a comparison among different δ values (0, 0.025 and 0.05 mm). The same comparisons are made for the broadside radiation gain and also the peak realized gain of the antenna which are shown in FIG. 17 and FIG. 18, respectively.

Figure 17:
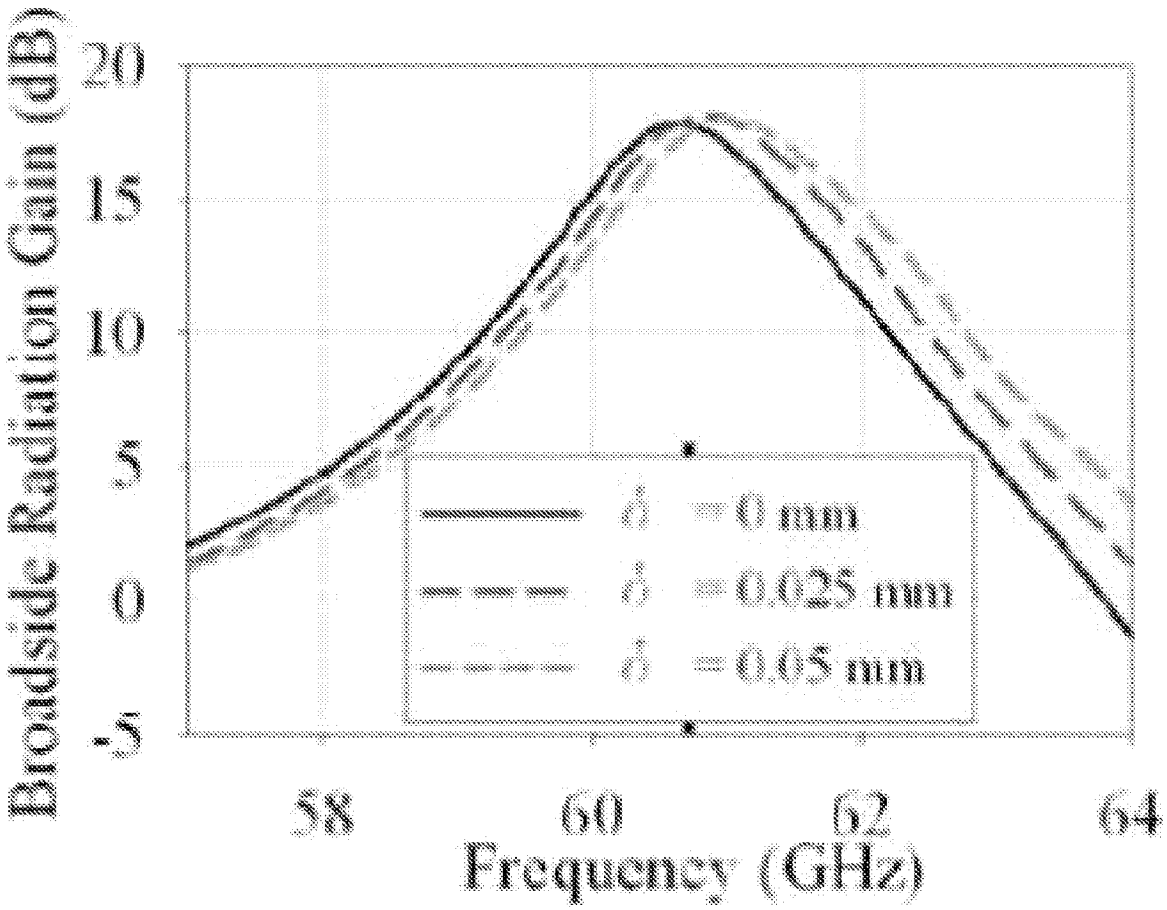
FIG. 17 illustrates a broadside radiation gain of a high-gain FPC antenna with a comparison among different values of δ.
Figure 18:
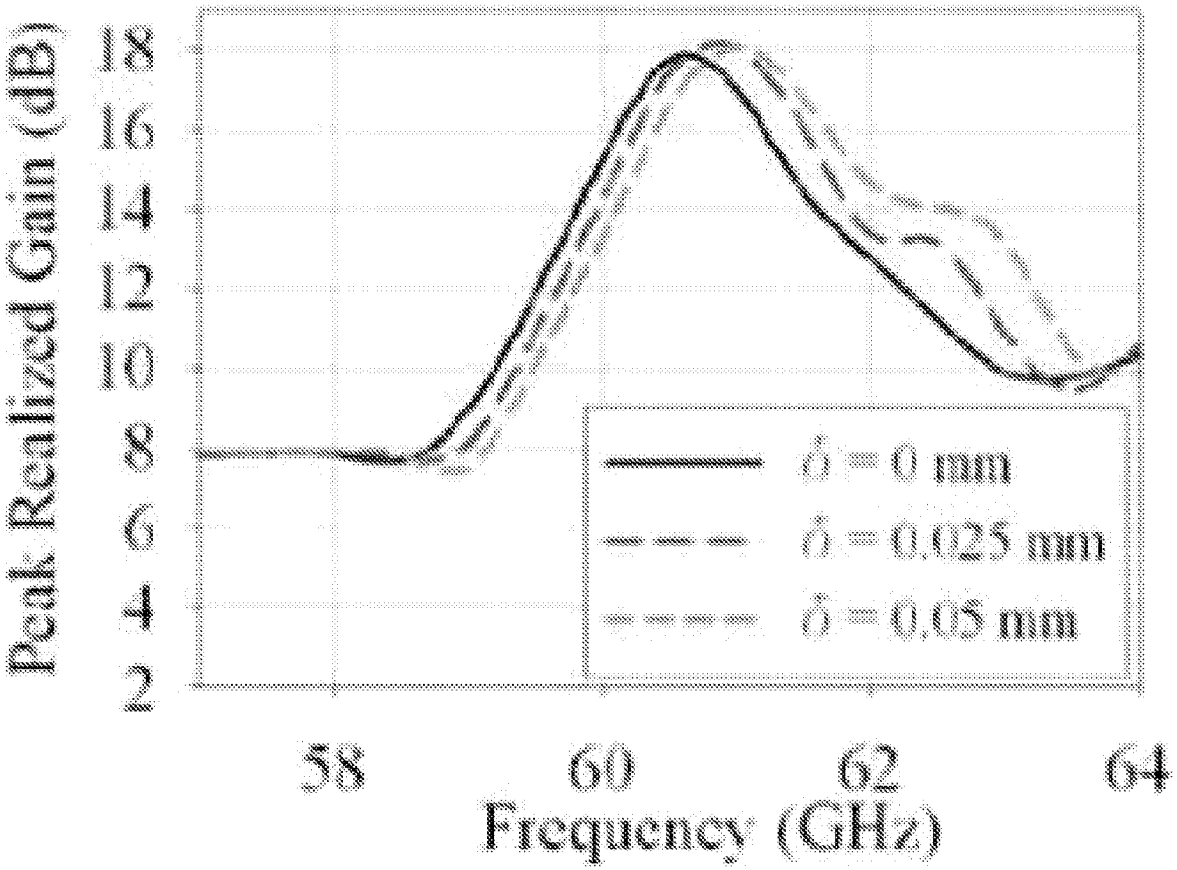
FIG. 18 illustrates a peak realized radiation gain of a high-gain FPC antenna with a comparison among different values of δ.

From FIG. 17, it can be seen that despite a little shift in the resonance frequency, the 3 dB pattern bandwidth of the antenna is increased from 1.4 GHz (uniform case) to 1.75 GHz (δ=0.05 mm which results 25% bandwidth improvement). This bandwidth behavior also may be seen from FIG. 18 for the peak radiation gain of the high-gain antenna.

Figure 19:
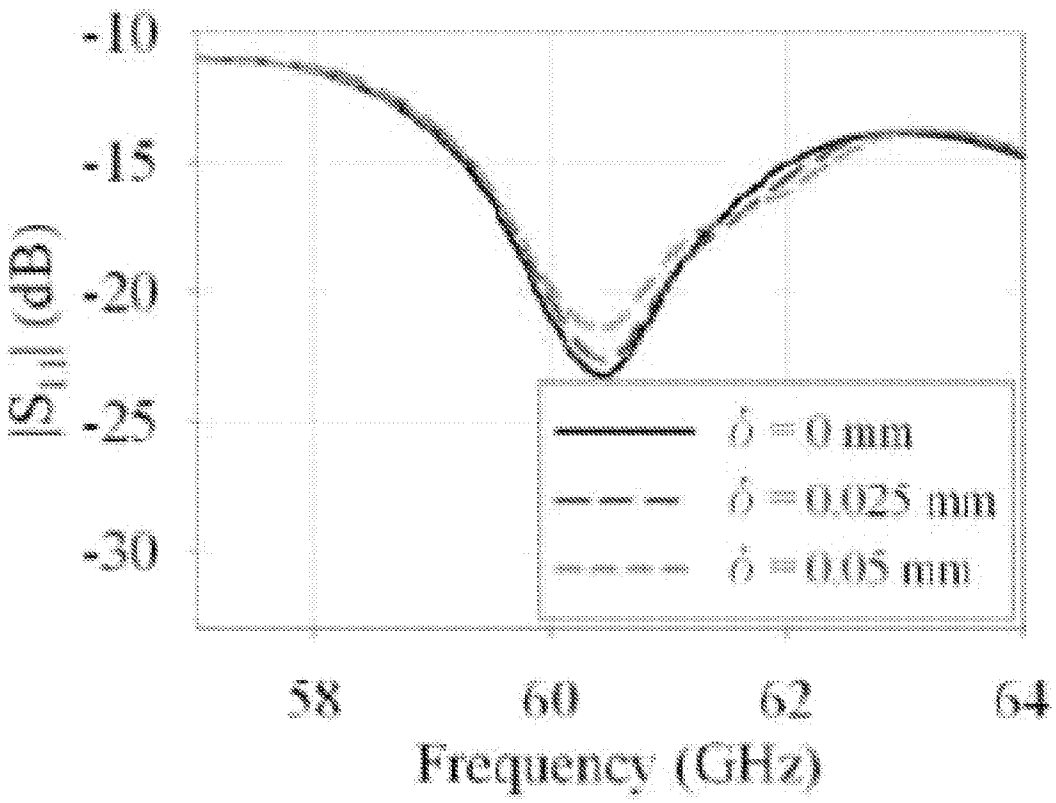
FIG. 19 illustrates a magnitude of a reflection coefficient of the mid-gain FPC antenna with a comparison among different values of δ.

FIG. 19 shows the magnitude of the reflection coefficient of the mid-gain antenna for δ=0, δ=0.025 mm and δ=0.05 mm.

Figure 20:
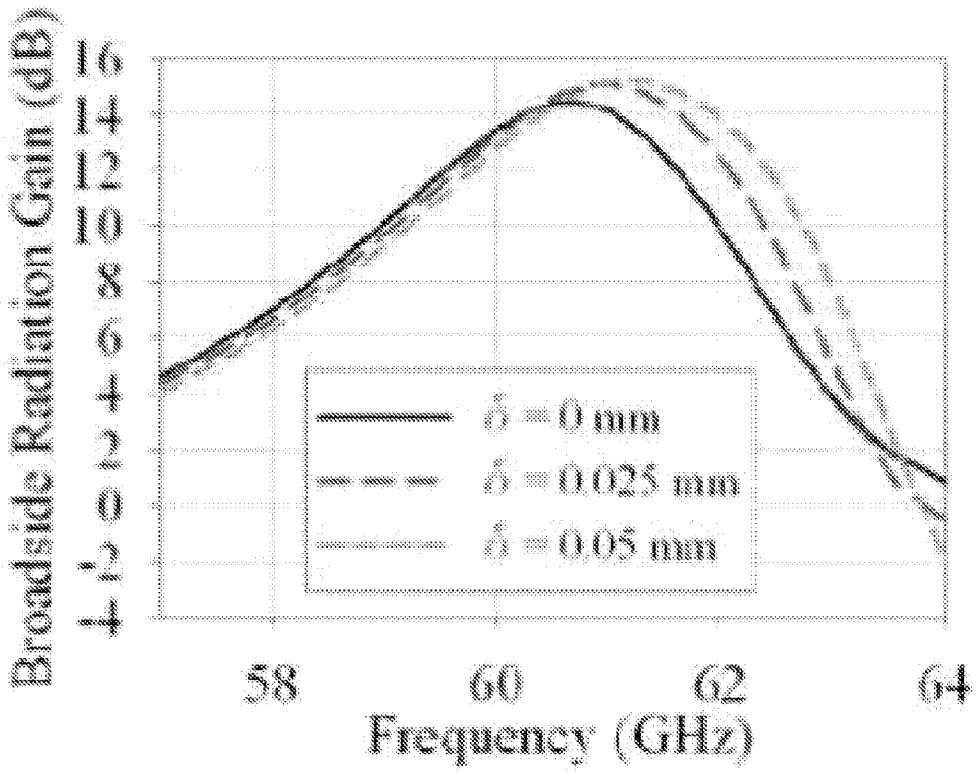
FIG. 20 illustrates a broadside radiation gain of a mid-gain FPC antenna with a comparison among different values of δ.
Figure 21:
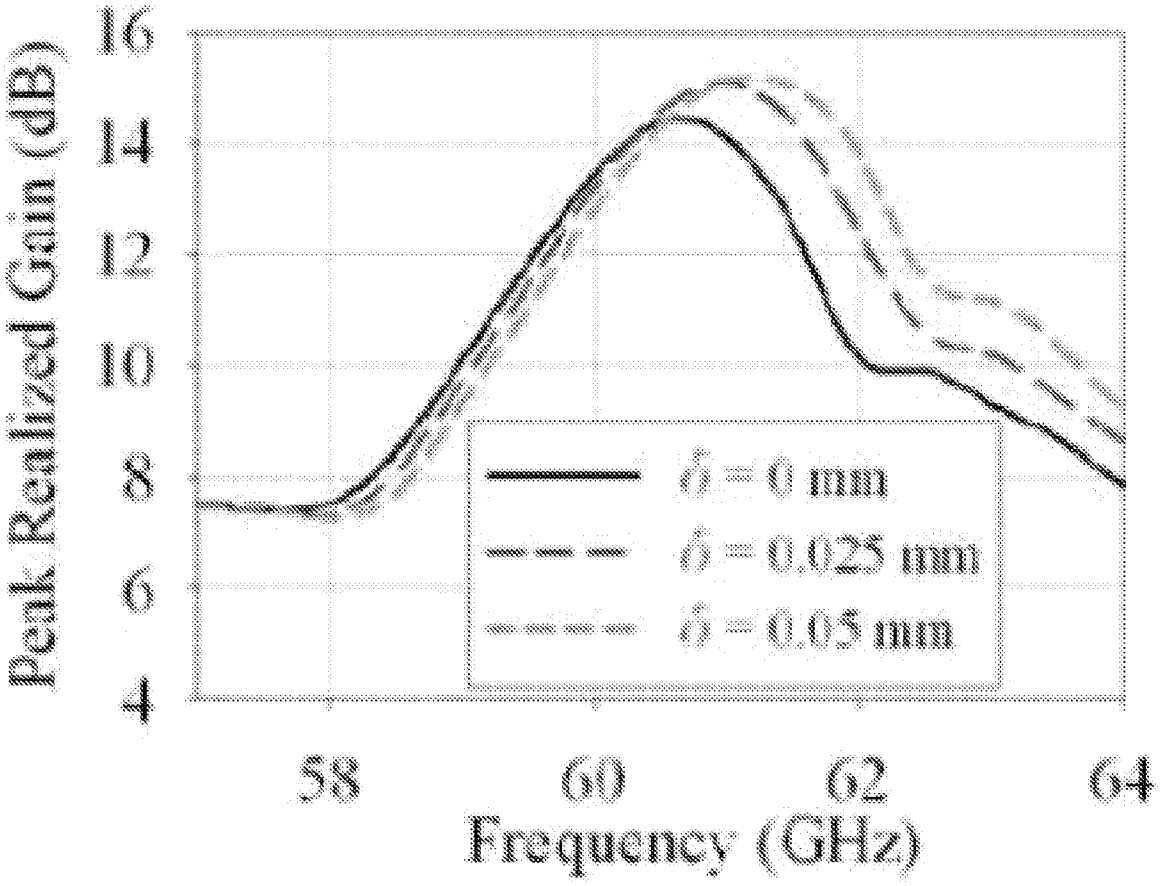
FIG. 21 illustrates a peak realized radiation gain of a mid-gain FPC antenna with a comparison among different values of δ.

FIG. 20 shows the broadside radiation gain of the mid-gain FPC antenna for δ=0, 0.025 and 0.05 mm. For this antenna, there is a small shifting in the resonance frequency, and but it can be seen that the 3 dB pattern bandwidth of the antenna is enhanced by 0.5 GHz (23%), from 2.2 GHz (the 3 dB pattern bandwidth of the standard FSS (uniform slot)) to 2.7 GHz (the 3 dB pattern bandwidth of the antenna with non-uniform FSS (δ=0.05)). FIG. 21 illustrates the peak realized gain of the mid-gain FPC antenna for different δ values.

Figure 22:
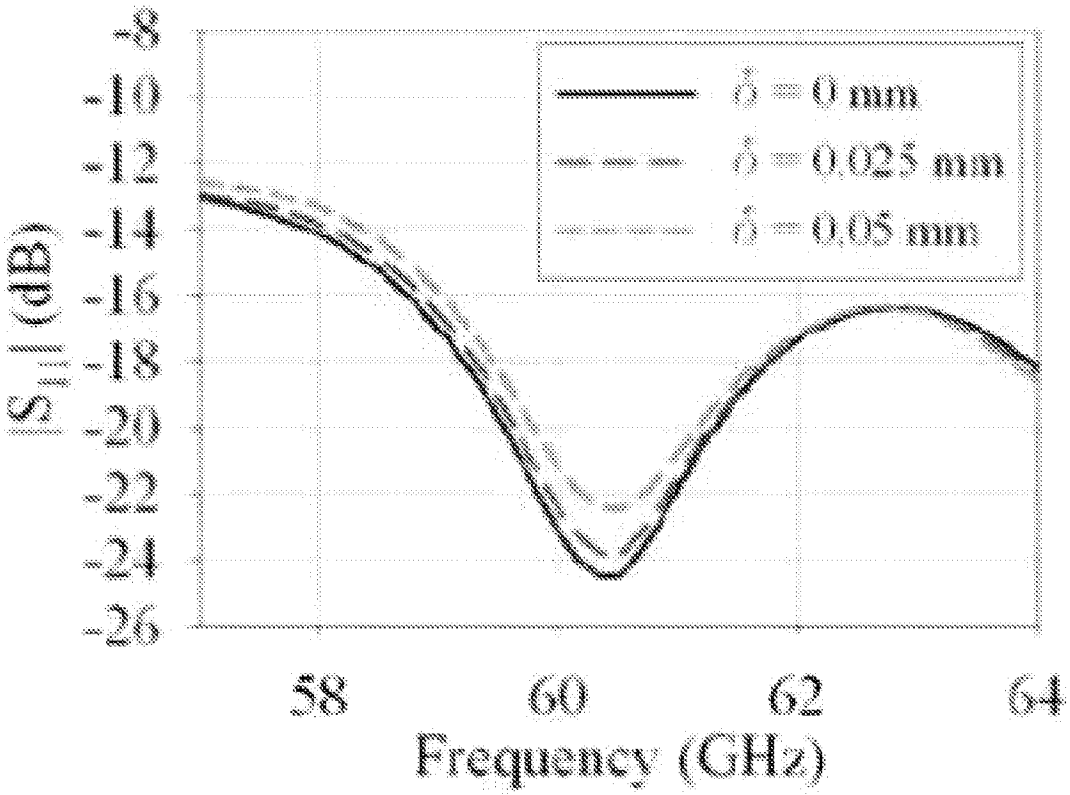
FIG. 22 illustrates a magnitude of a reflection coefficient of a low-gain FPC antenna with a comparison among different values of δ.

FIG. 22 shows the magnitude of the reflection coefficient of the low-gain antenna for different δ values for both uniform and non-uniform FSS layers.

Figure 23:
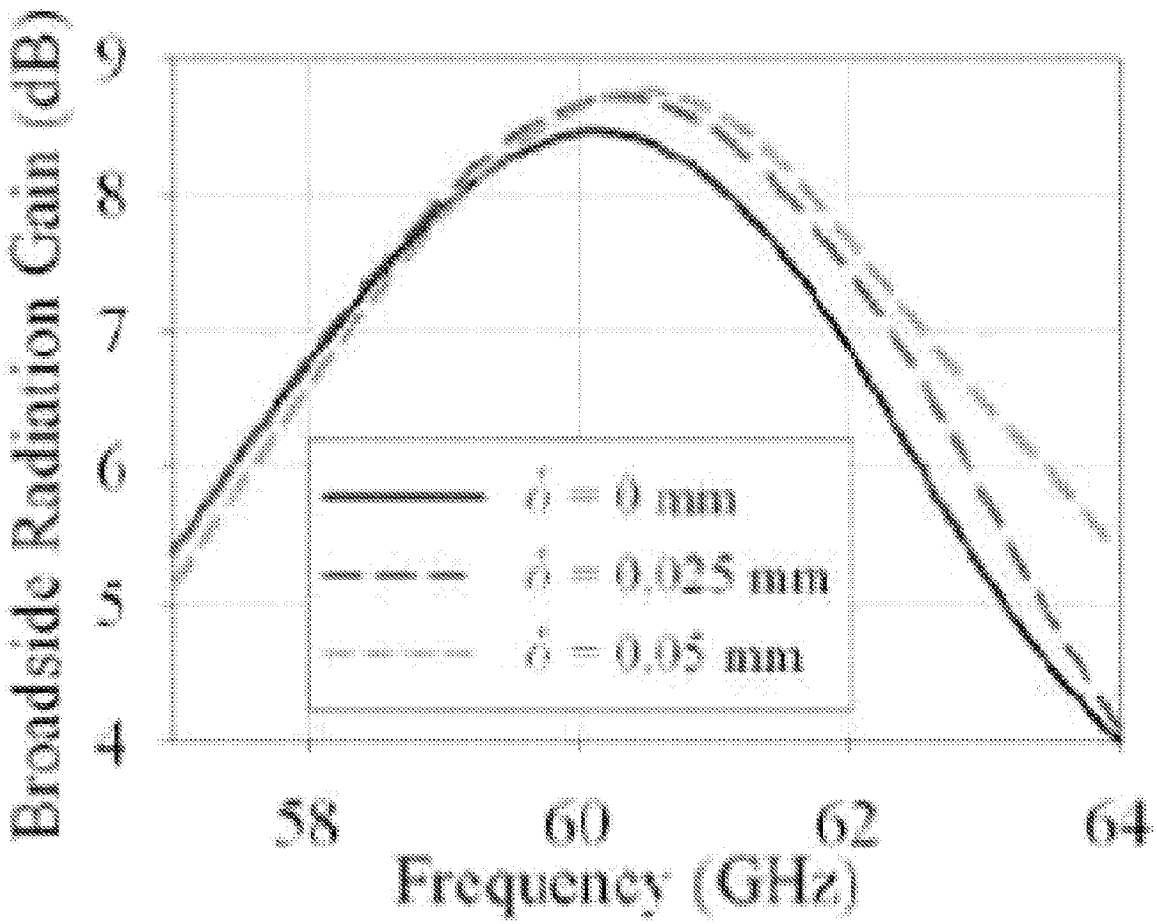
FIG. 23 illustrates a broadside radiation gain of a low-gain FPC antenna with a comparison among different values of δ.
Figure 24:
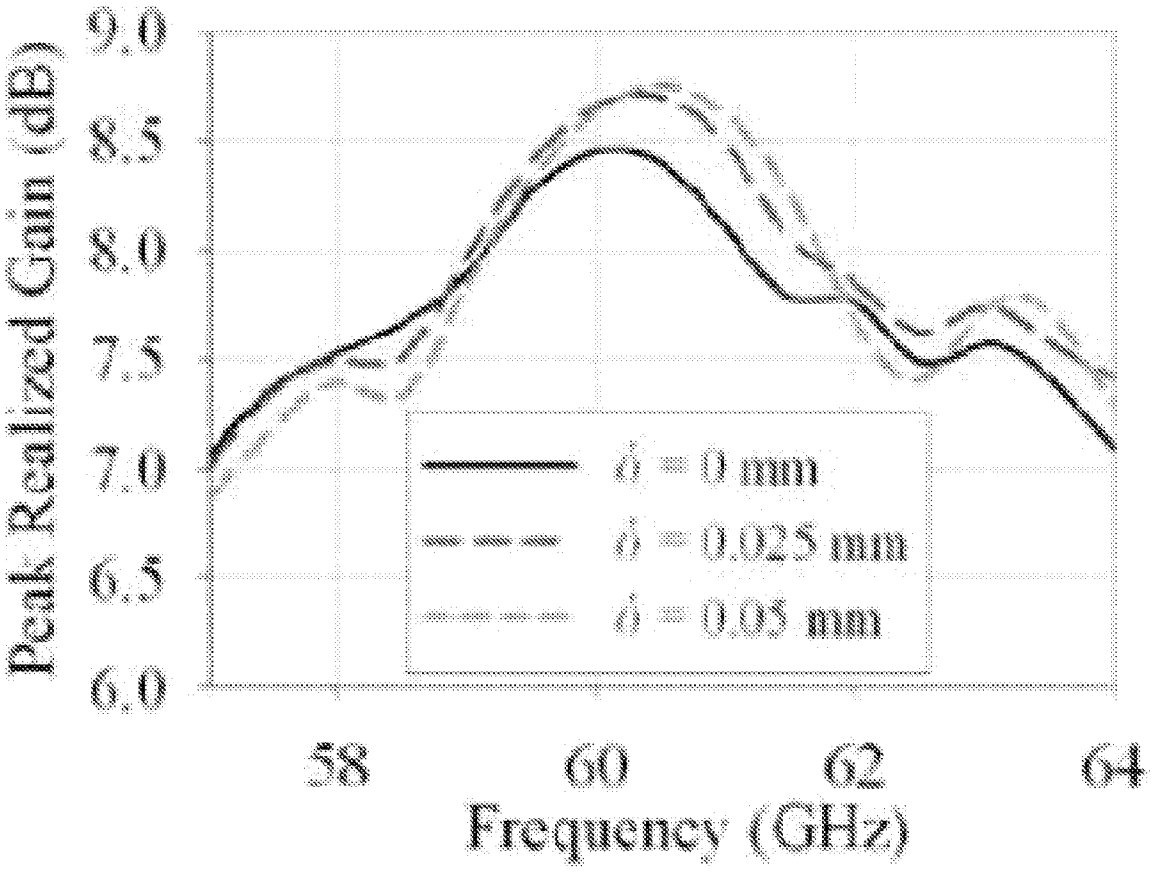
FIG. 24 illustrates a peak realized radiation gain of a low-gain FPC antenna with a comparison among different values of δ.

FIG. 23 and FIG. 24 show the broadside radiation and the peak realized gain of the low-gain FPC antenna versus frequency for different δ values, respectively. As shown, the maximum gain of the antenna is increased by 0.25 GHz with a little shift in frequency. The 3 dB pattern bandwidth of the antenna is increased by 0.75 GHz (13%), from 5.75 GHz (uniform FSS, δ=0 mm) to 6.5 GHz (non-uniform FSS, δ=0.05 mm).

TABLE II

DESIGN PARAMETERS OF FPC ANTENNAS, DESIGNED AT 60 GHZ, WITH THE SAME RADIATION GAIN FOR DIFFERENT FSS THICKNESS

| FSS # | $\hat{b}$ | $\hat{g}$ | Resonance Height (mm) |
|---|---|---|---|
| 1 | 3.715 | 0.754 | 2.291 |
| 2 | 3.229 | 0.603 | 2.261 |
| 3 | 2.365 | 0.415 | 2.189 |

In one embodiment, the percentage of the improvement in the pattern bandwidth of the antenna decreases by decreasing the maximum gain of the antenna. Further, the more reflective the PRS layer, the more bandwidth improvement is achieved.

In another embodiment, the 3 dB pattern bandwidth of a FPC antenna may be optimized by varying the slot distribution, i.e., a nonlinear δ.

Figure 25:
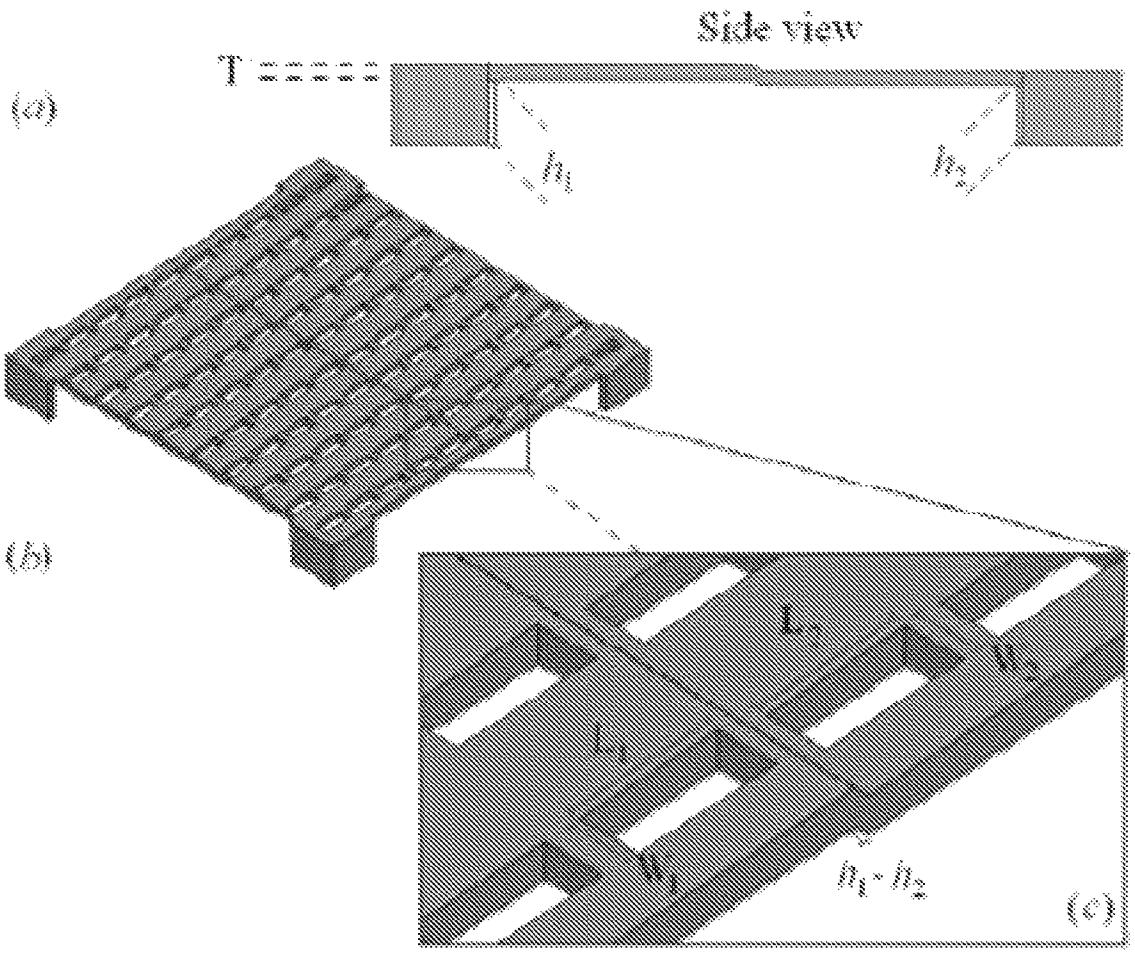
FIG. 25(*a*) illustrates a multi-level FSS in a side view in an embodiment.

The pattern bandwidth of a FPC antenna covered by a multi-layer thick FSS based on dividing the FSS layer to two same-size sections which are divided exactly over the feeding point of the cavity as shown in FIG. 25 may be used. The two mentioned sections may have two different resonance heights (h1 and h2) and/or two different slots (i.e. L1 and L2) as shown in FIG. 25(*c*).

Dividing the FSS layer into two identical sections may enable the, propagating wave inside the cavity to be divided into two identical portions. The FSS layer may be designed to radiate with 3 dB more gain with respect to the desired gain of the 2-level-FSS FPC antenna.

In one embodiment, a FPC antenna may be covered by a two-level FSS layer with identical slot dimensions. This antenna may be designed with slot dimensions $L_1$=L2=2 mm and W1=W2=0.8 mm and the resonance heights of $h_1$=2.35 mm and h2=2.225 mm. The antenna radiates with 13 dB maximum radiation gain with the 3 dB pattern bandwidth of 3.45 GHz.

In order to show the 3 dB pattern bandwidth enhancement in an embodiment, from the above embodiment may be compared to a FPC antenna covered by a uniform thick FSS with the maximum gain of 13 dB (L=2.15 mm, W=0.8 mm, T=0.5 mm, h=2.22 mm, ĝ=0.6876 and b^=2.298).

Figure 26:
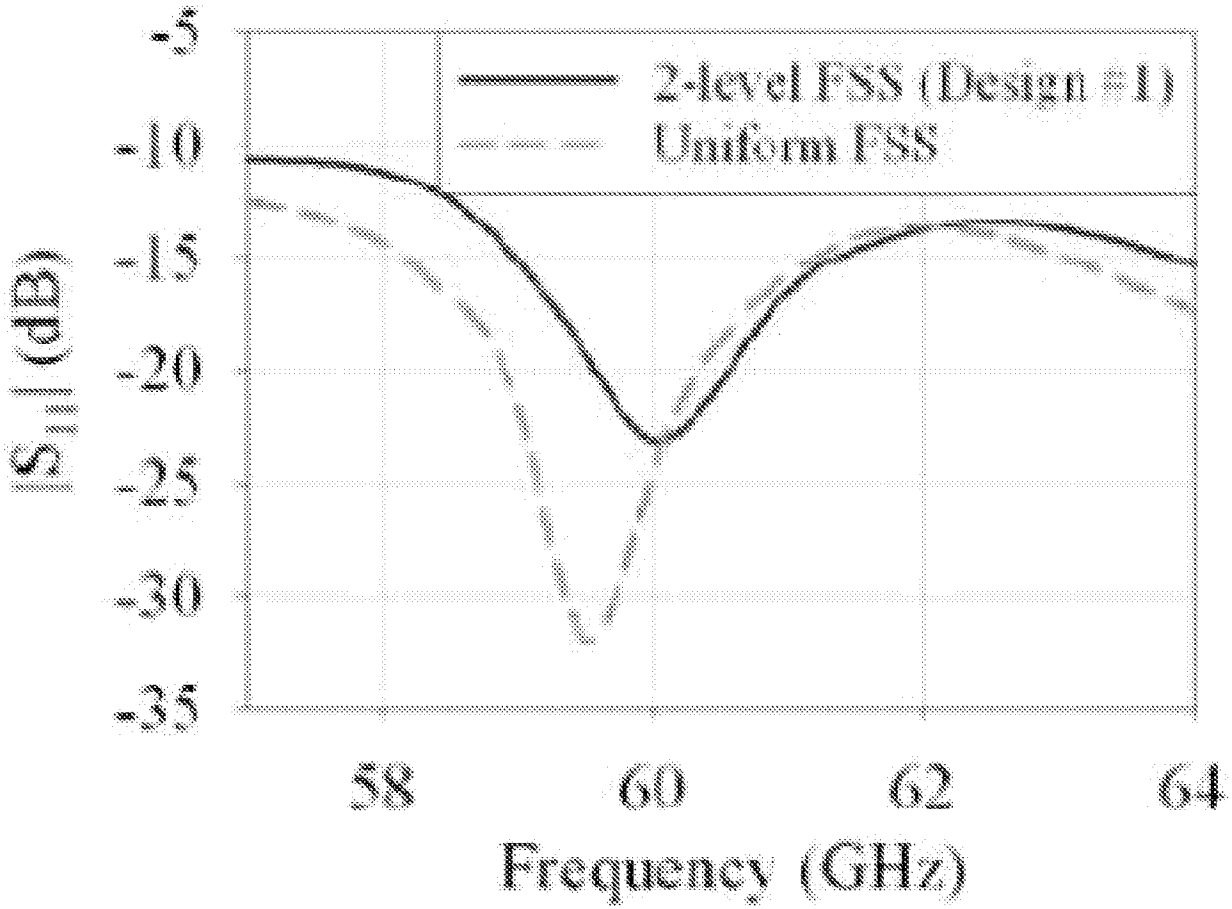
FIG. 26 illustrates a magnitude of the reflection coefficient of FPC antennas covered by a uniform FSS and the 2-level FSS in an embodiment.

FIG. 26 shows a comparison between the magnitude of the reflection coefficients of the above example and the same-gain uniform-FSS FPC antenna versus frequency.

Figure 27:
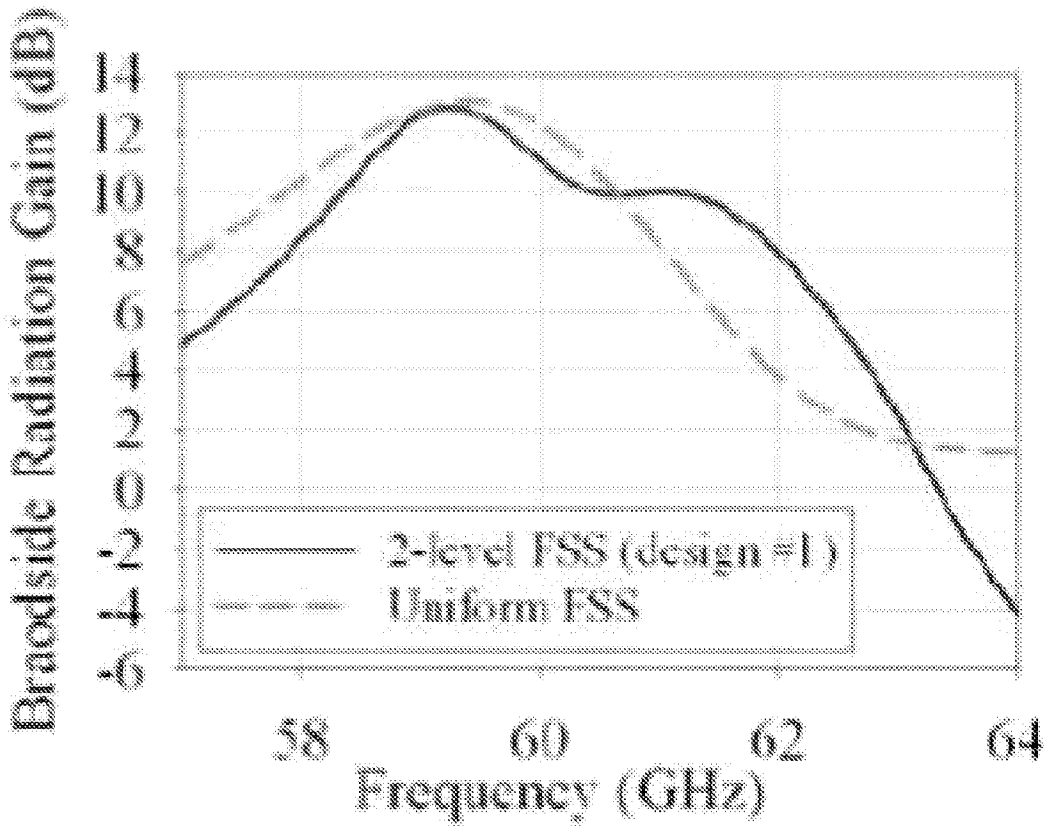
FIG. 27 illustrates a broadside radiation gain of FPC antennas covered by a uniform FSS and the 2-level FSS in an embodiment.

FIG. 27 illustrates the broadside radiation gain of the FPC antennas versus frequency including a comparison between the FPC antenna covered by a uniform FSS and the embodiment above. The 3 dB pattern bandwidth of the FPC antenna covered by a uniform FSS is around 2.7 GHz, which is 0.75 GHz smaller than the FPC antenna above.

Figure 28:
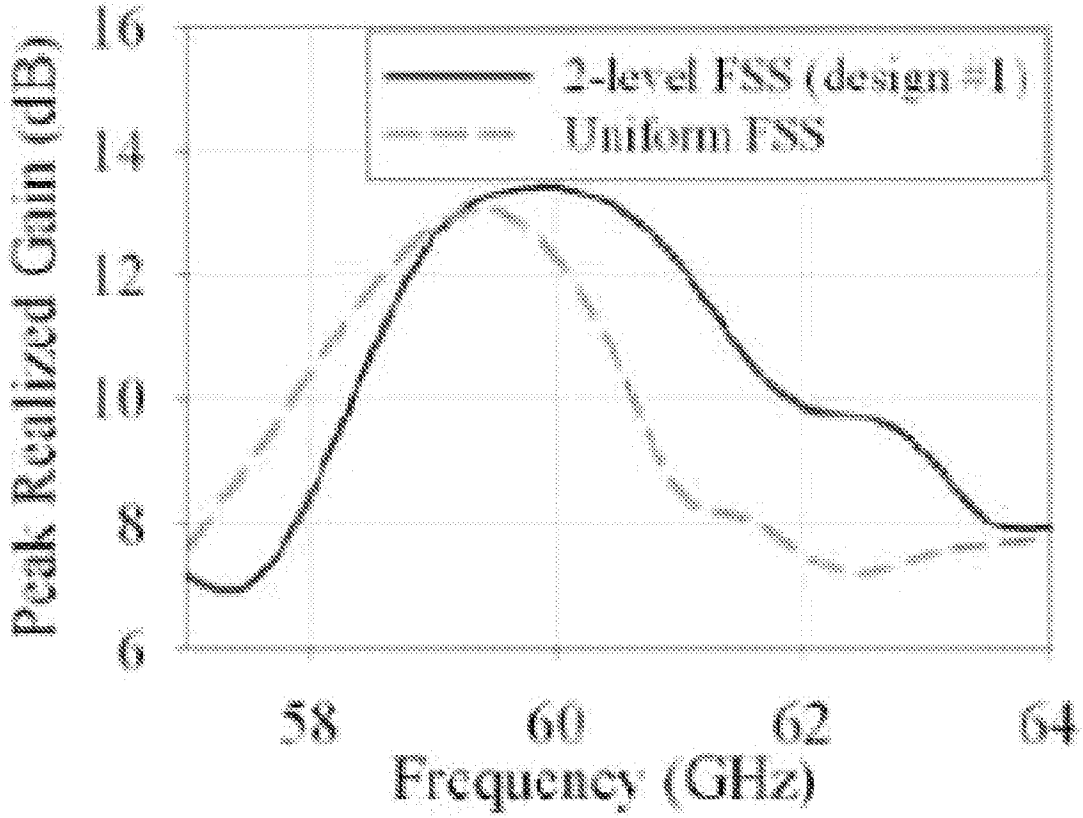
FIG. 28 illustrates a peak realized radiation gain of FPC antennas covered by a uniform FSS and the 2-level FSS in an embodiment.

FIG. 28 illustrates the peak realized radiation gain of the FPC antennas versus frequency including a comparison between two FPC antennas covered by the introduced FSS and a uniform FSS.

In another embodiment, a 2-level-FSS FPC antenna based on different slot lengths as well as different resonance heights of the two sections of the FSS may be configured. The slot dimensions are $L_1$=2.06 mm, L2=1.93 mm, $W_1$=W2=0.8 mm and T=0.5 mm with the resonance heights of $h_1$=2.28 mm and h2=2.225 mm. The antenna may radiate with a maximum gain of 11 dB with the 3 dB pattern bandwidth of 4.2 GHz. This embodiment may be compared with the e FPC antenna covered by a uniform-FSS with maximum gain of 11 dB with the dimensions of L=2.145 mm, W=0.8 mm, T=0.5 mm and the resonance height of h=2.133 mm.

Figure 29:
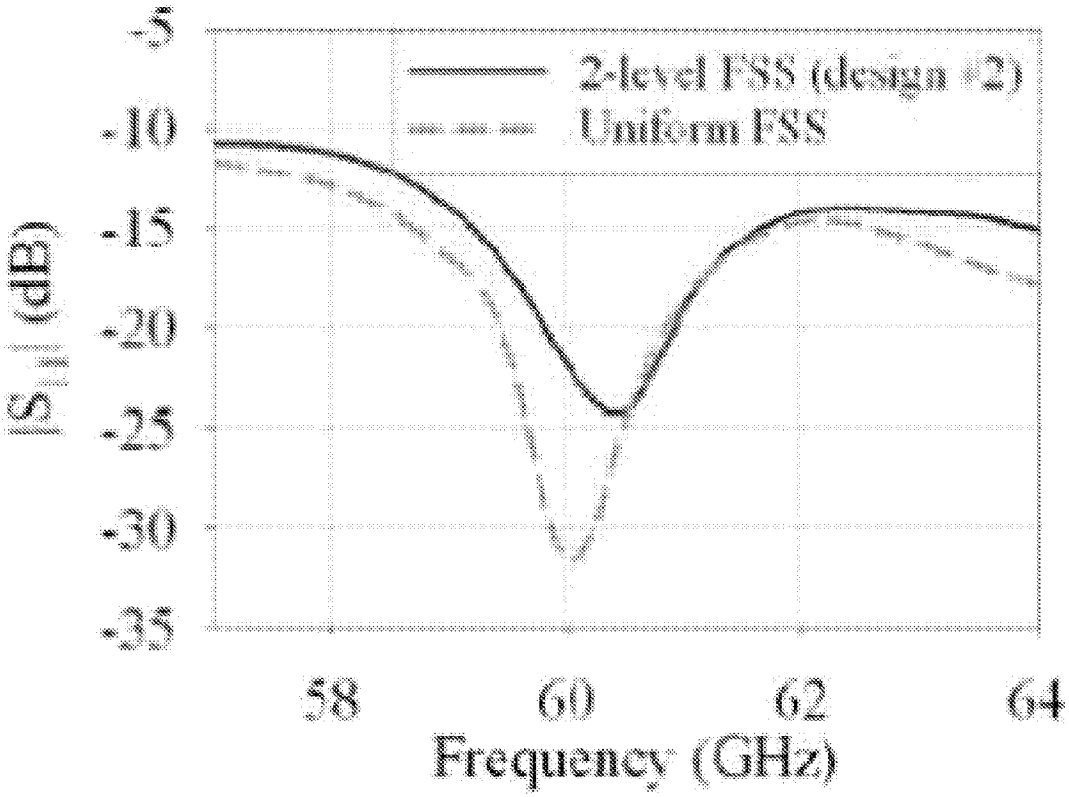
FIG. 29 illustrates a magnitude of a reflection coefficient of FPC antennas covered by a uniform FSS and the 2-level FSS in an embodiment.

FIG. 29 shows the magnitude of the reflection coefficient of the FPC antennas covered by the described FSS layers, the new 2-level FSS (design #2) and the uniform FSS. The impedance bandwidth of the FPC antennas covers the entire 60 GHz wireless band, form 57 GHz to 64 GHz.

Figure 30:
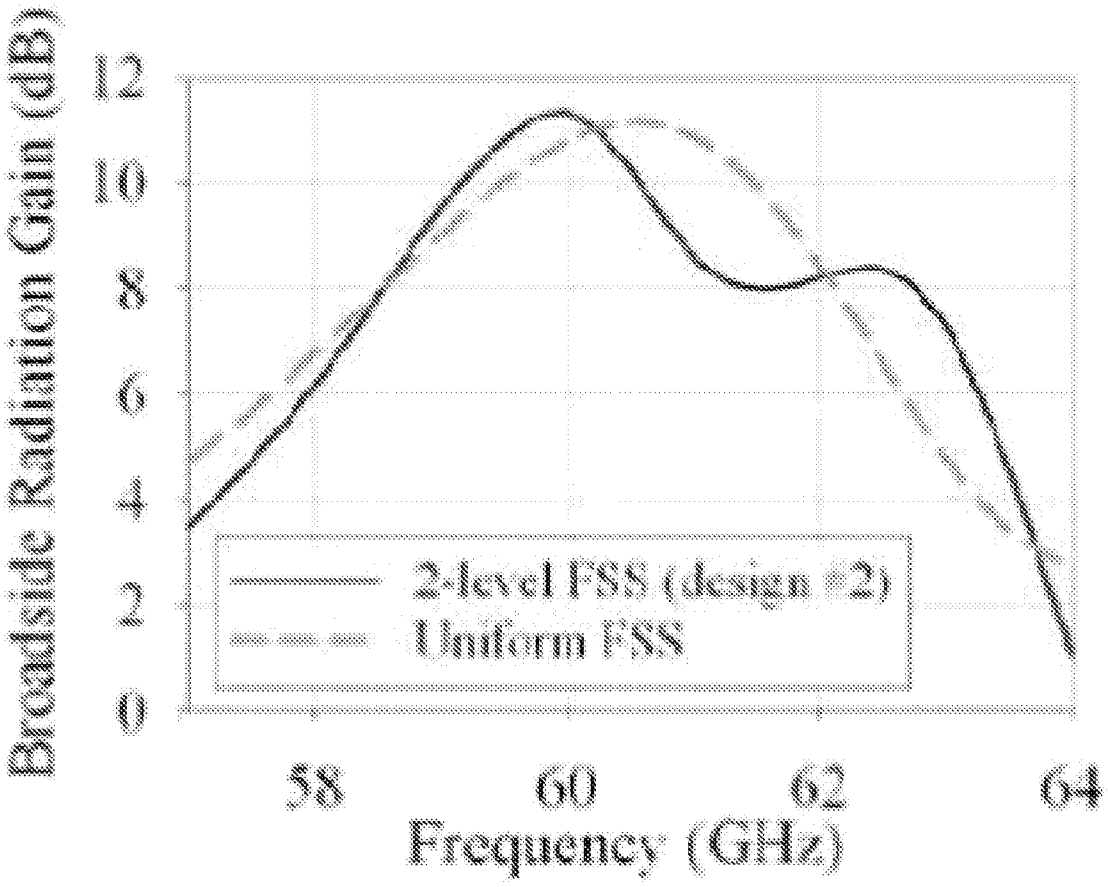
FIG. 30 illustrates a broadside radiation gain of FPC antennas covered by a uniform FSS and the 2-level FSS in an embodiment.

The broadside radiation gain of the FPC antennas is shown in FIG. 30. Using a 2-level FSS (design #2), the 3 dB pattern bandwidth of the FPC antenna may be increased by 0.6 GHz (17%), from 3.6 GHz (uniform FSS) to 4.2 GHz for the 2-level FSS. The peak realized radiation gain of the FPC antennas versus frequency is shown in FIG. 31, which is a comparison between 2-level FSS (design #2) and the uniform-slot FSS.

Figure 31:
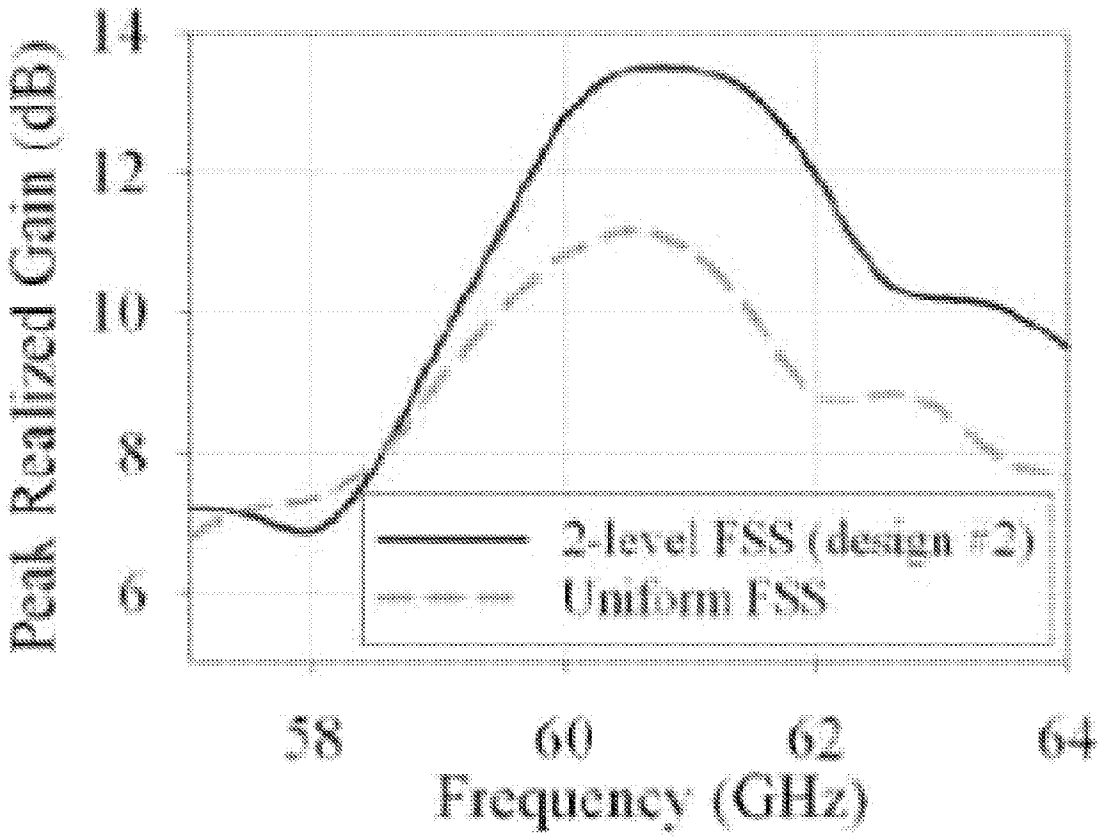
FIG. 31 illustrates a peak realized radiation gain of FPC antennas covered by a uniform FSS and the 2-level FSS in an embodiment.

By comparing the peak realized gain of the FPC antennas covered by 2-level FSS layers as shown in FIG. 28 and FIG. 31, respectively, the peak realized gain of the antenna covered by 2-level-FSS, is around 2 dB larger than the broadside gain of the antenna. These numbers are almost the same for the FPC antenna covered by the 2-level-FSS.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that a certain of the details described herein can be varied considerably without departing from the basic principles of the invention.

The invention claimed is:

1. A wireless antenna system, comprising:

a ground plane;

a frequency selective surface (FSS) including a plurality of slots and covering at least a portion of the ground plane to form a cavity;

a planar antenna configured to feed the cavity;

a coplanar waveguide configured to excite a feed of the antenna, wherein the plurality of slots are configured in a non-uniform pattern, and wherein the length of the slots is decreased as the distance from a center of the antenna is increased.

2. The system of claim 1, wherein the antenna is a leaky-wave antenna.

3. The system of claim 1, wherein the antenna is configured to operate at a frequency of at least about 57 GHz.

4. The system of claim 1, wherein the antenna is configured to operate at millimeter wave frequencies.

5. The system of claim 1, wherein length and/or the width of the slots are varied to achieve a predetermined gain.

6. The system of claim 1, wherein the antenna is configured to resonant at or about the central frequency of the cavity.

7. The system of claim 1, wherein the FSS is suspended above the antenna by a plurality of legs and/or metallic walls.

8. The system of claim 1, wherein the antenna is fed from the front or the back.

9. The system of claim 1, wherein the FSS includes at least two layers.

10. The system of claim 9, wherein the FSS includes at least approximately equal size layers divided approximately equally over a feeding point of the cavity.

11. The system of claim 1, wherein planar antenna is a slot dipole or bowtie antenna.

12. The system of claim 11, wherein the at least two sections include different slot lengths and/or different resonant heights.

13. The system of claim 1, wherein the FSS is formed at least in part from a metallic material.

14. A method for forming an antenna system, comprising:

forming a frequency selective surface (FSS) including a plurality of slots and covering at least a portion of a ground plane to form a cavity;

feeding the cavity with a planar antenna; and feeding the antenna with a coplanar waveguide, wherein the plurality of slots are configured in a non-uniform pattern, and wherein the length of the slots is decreased as the distance from a center of the antenna is increased.

15. The method of claim 14, wherein the antenna is a leaky-wave antenna.

16. The method of claim 14, wherein the antenna is configured to operate at a frequency of at least about 57 GHz.

17. The method of claim 14, wherein the antenna is configured to operate at millimeter wave frequencies.

18. The method of claim 14, wherein length and/or the width of the slots are varied to achieve a predetermined gain.

* * * * *